US011333334B2

(12) United States Patent
Dixit et al.

(10) Patent No.: US 11,333,334 B2
(45) **Date of Patent: *May 17, 2022**

(54) ROTATABLE LIGHT FIXTURE SECURED TO A JUNCTION BOX VIA A BASE

(71) Applicant: HeathCo LLC, Bowling Green, KY (US)

(72) Inventors: Kushagra Dixit, Bowling Green, KY (US); Miles William McDonald, Bowling Green, KY (US); Lionel V. Luu, Bowling Green, KY (US); Scott Blaise Tylicki, Bowling Green, KY (US); John Colvin Deaton, Bowling Green, KY (US); Apollo Paul Paredes, Livonia, MI (US); Leeman Elliot Stevens, Bowling Green, KY (US); Amer Salihovic, Bowling Green, KY (US); Stephen Brett Thompson, Peachtree Corners, GA (US)

(73) Assignee: HEATHCO LLC, Bowling Green, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/035,100

(22) Filed: Sep. 28, 2020

(65) Prior Publication Data

US 2021/0010662 A1 Jan. 14, 2021

Related U.S. Application Data

(63) Continuation-in-part of application No. 16/259,219, filed on Jan. 28, 2019, now Pat. No. 10,788,194.
(Continued)

(51) Int. Cl.
*F21V 21/14* (2006.01)
*F21V 23/00* (2015.01)
(Continued)

(52) U.S. Cl.
CPC ..... *F21V 21/14* (2013.01); *F21V 21/35* (2013.01); *F21V 23/002* (2013.01); *F21Y 2115/10* (2016.08)

(58) Field of Classification Search
CPC ..... F21V 21/30; F21V 23/002; F21V 21/14; F21S 8/04
See application file for complete search history.

(56) References Cited

U.S. PATENT DOCUMENTS 2,032,018 A 2/1936 Holmes
2,199,905 A 5/1940 Arras
(Continued)

FOREIGN PATENT DOCUMENTS

CA 2950554 A1 6/2018
CN 203517653 U 4/2014
(Continued)

OTHER PUBLICATIONS

IQ America, Instruction Manual, Promotional LED Motion Sensor Light, LP1803, Jan. 27, 2016.
(Continued)

*Primary Examiner* — Karabi Guharay
(74) *Attorney, Agent, or Firm* — Middleton Reutlinger

(57) ABSTRACT

Methods and apparatus for a rotatable light fixture secured to a junction box via a mounting base. The electrical and/or mechanical connection between the light fixture housing and the mounting base may maintain the electrical coupling during rotation. The light fixture housing may be rotationally secured in a variety of rotational orientations relative to the mounting base.

29 Claims, 14 Drawing Sheets

Related U.S. Application Data

(60) Provisional application No. 63/077,848, filed on Sep. 14, 2020, provisional application No. 62/623,296, filed on Jan. 29, 2018.

(51) Int. Cl.
*F21V 21/35* (2006.01)
*F21Y 115/10* (2016.01)

(56) References Cited

U.S. PATENT DOCUMENTS

| | | | |
|---|---|---|---|
| 2,984,738 | A | 5/1961 | Belau |
| 4,240,999 | A | 12/1980 | Decker et al. |
| 4,464,707 | A | 8/1984 | Forrest |
| 5,107,120 | A | 4/1992 | Tom |
| 5,148,158 | A | 9/1992 | Shah |
| 5,258,899 | A | 11/1993 | Chen |
| 5,649,761 | A | 7/1997 | Sandell et al. |
| 5,677,529 | A | 10/1997 | Hofmann et al. |
| 6,082,878 | A | 7/2000 | Doubek et al. |
| 6,100,803 | A | 8/2000 | Chang |
| 6,175,309 | B1 | 1/2001 | Drake |
| 6,217,340 | B1 | 4/2001 | Gordon |
| 6,764,197 | B1 | 7/2004 | Zemar |
| 6,781,129 | B2 | 8/2004 | Leen |
| 6,793,499 | B1 | 9/2004 | Chen |
| 6,844,555 | B2 | 1/2005 | Beasley |
| D515,226 | S | 2/2006 | Beasley |
| 7,052,171 | B1 | 5/2006 | Lefebvre et al. |
| 7,375,313 | B2 | 5/2008 | Lee |
| 7,473,899 | B2 | 1/2009 | Chi et al. |
| 7,543,958 | B2 | 6/2009 | Chi et al. |
| 7,635,846 | B2 | 12/2009 | Chi et al. |
| 7,641,366 | B1 | 1/2010 | Sibalich et al. |
| 7,654,705 | B2 | 2/2010 | Czech et al. |
| 7,740,499 | B1 | 6/2010 | Willey et al. |
| 8,348,215 | B1 | 1/2013 | Smith |
| 8,461,991 | B2 | 6/2013 | Botha |
| 8,608,502 | B2 | 12/2013 | Witter et al. |
| 9,188,320 | B2 | 11/2015 | Russello et al. |
| 9,243,786 | B1 | 1/2016 | Onda et al. |
| 9,595,794 | B2 | 3/2017 | Birdwell et al. |
| 9,839,088 | B1 | 12/2017 | Deaton |
| 9,920,912 | B1 | 3/2018 | Zhang et al. |
| 9,970,611 | B2 | 5/2018 | Toner |
| 10,107,480 | B1 | 10/2018 | Ladewig et al. |
| D869,721 | S | 12/2019 | Recker et al. |
| 10,533,736 | B2 | 1/2020 | Chen |
| 10,718,500 | B1 | 7/2020 | Tylicki et al. |
| 10,788,194 | B2 | 9/2020 | Stevens et al. |
| 2004/0090781 | A1 | 5/2004 | Yeoh |
| 2008/0239709 | A1 | 10/2008 | Rapeanu et al. |
| 2010/0259383 | A1 | 10/2010 | Botha |
| 2014/0103214 | A1 | 4/2014 | Messiou et al. |
| 2015/0092408 | A1 | 4/2015 | Wallach |
| 2015/0330587 | A1 | 11/2015 | Lax et al. |
| 2016/0003461 | A1 | 1/2016 | Chen |
| 2016/0131346 | A1 | 5/2016 | Creasman et al. |
| 2016/0369991 | A1 | 12/2016 | Lim |
| 2018/0195703 | A1 | 7/2018 | Bailey et al. |
| 2019/0113220 | A1* | 4/2019 | Haase ..... F21V 29/713 |
| 2019/0211985 | A1 | 7/2019 | Wijaya et al. |

FOREIGN PATENT DOCUMENTS

| | | | |
|---|---|---|---|
| CN | 203771112 | U | 8/2014 |
| CN | 203771209 | U | 8/2014 |
| CN | 203771272 | U | 8/2014 |
| CN | 203771279 | U | 8/2014 |
| CN | 203773612 | U | 8/2014 |
| CN | 203868804 | U | 10/2014 |
| EP | 1365370 | A1 | 11/2003 |
| EP | 1727104 | A1 | 11/2006 |
| EP | 2577243 | B1 | 2/2015 |
| JP | 4518268 | B2 | 8/2010 |
| WO | WO2008093163 | A2 | 8/2008 |
| WO | WO2012056268 | A1 | 5/2012 |
| WO | WO2012056269 | A1 | 5/2012 |
| WO | WO2012056270 | A1 | 5/2012 |
| WO | WO2012093291 | A1 | 7/2012 |
| WO | WO2014021706 | A1 | 2/2014 |
| WO | WO2015047078 | A1 | 4/2015 |
| WO | WO2016209068 | A2 | 12/2016 |
| WO | WO2016209069 | A1 | 12/2016 |
| WO | WO2017007299 | A1 | 1/2017 |

OTHER PUBLICATIONS

IQ America, Instruction Manual, Motion Sensor LED Lights, LM-1802, Jan. 5, 2016.

Halo, Instruction Manual, Eaton, Retrieved from https://images.homedepot-static.com/catalog/pdfImages/36/36eb2571-b44b-4c59-83c6-9c06541ebd54.pdf, Retrieved on Mar. 27, 2020.

IQ America,180-Degree Bronze Motion Activated Outdoor Integrated LED Flood Light with 1500 Lumens, Retrieved from: https://www.homedepot.com/p/IQ-America-180-Degree-Bronze-Motion-Activated-Outdoor-Integrated-LED-Flood-Light-with-1500-Lumens-LM-1801-BZ/301302474, Retrieved on May 21, 2021.

IQ America, 180-Degree White Motion Activated Outdoor Integrated LED Twin Flood Lights with 1500 Lumens, Retrieved from: https://www.homedepot.com/p/IQ-America-180-Degree-White-Motion-Activated-Outdoor-Integrated-LED-Twin-Flood-Lights-with-1500-Lumens-LM-1802-WH/301304226, Retrieved on May 21, 2021.

IQ America, 1801 Motion Sensor LED Lights, IQ America Instruction Manual, dated Jan. 5, 2016.

* cited by examiner

ROTATABLE LIGHT FIXTURE SECURED TO A JUNCTION BOX VIA A BASE

BACKGROUND

Light fixtures are generally wired directly or indirectly through a connecting base to a junction box, however this may not allow for adjustments to the rotation, mounting, and aiming of the fixture without breaking the electrical contact from the junction box and/or connecting base as a result of the initial orientation of the junction box and/or connecting base.

SUMMARY

In various embodiments, a rotatable light fixture and receiving mounting base which maintains electrical connectivity between the light fixture and the mounting base, may comprise the mounting base mountable against a surface and being electrically connectable to a junction box. In some embodiments, the mounting base includes a plurality of rotational exposed contacts along about the annular position of each of the rotationally exposed contacts. In some embodiments, the light fixture including a plurality of electrical contacts in rotational engagement with the plurality of annularly exposed contacts of the mounting base. In various embodiments, the light fixture maintains electrical connectivity between the electrical contacts of the light fixture and the contact of the mounting base for about 360 degrees of rotational between the light fixture and the mounting base. In addition, in some embodiments, the light fixture includes a plurality of modulated LEDs controlled by an LED controller, the plurality of LEDs in electrical connectivity with the electrical contacts of the light fixture. In various embodiments, the mounting base and the light fixture rotationally engage each other and are rotationally secured to each other through a mechanical locking mechanism. In some embodiments, the mechanical locking mechanism includes at least one of a cam lock and one or more retention members on the light fixture or base, the light fixture or mounting base including an annular groove, at least one of the cam lock and the one or more retention members engage outer surface of the opposing structure or the annular groove.

In further embodiments, the cam lock may be rotationally engaged retained on the light fixture and rotate relative to the base. Rotation of the cam lock allows the cam lock to lock the light fixture into a fixed relative positioned with respect to the base by engaging a corresponding groove of the base upon rotation.

In addition, in some embodiments, the plurality of rotational contacts of the mounting base and the plurality of electrical contacts of the light fixture include at least one of an annular ring and a leaf spring. In various embodiments, the leaf spring includes a plurality of leaf springs. In some embodiments, the plurality of leaf springs are located on the light fixture. In various embodiments, the annular rings include a plurality of annular rings. In some embodiments, the annular rings are located on the mounting base. In even further embodiments, the annular rings of the mounting base are positioned in an associated number of annular grooves which receive the rings. In even further embodiments, a third contact or disc may be centrally located and positioned relative to the annular rings on the mounting base. Moreover, in various embodiments, the plurality of rotational exposed contacts on the mounting base include a rotatable electrical plug which receives an electrically rotatable mating plug on the light fixture.

In some embodiments, a rotatable light fixture may comprise a mounting base electrically coupled to a junction box. In various embodiments, the light fixture may include a light fixture housing rotatably connected to the mounting base defining a plurality of rotational orientations between the light fixture housing and the mounting base. In some embodiments, the light fixture may include an electrical connection between the mounting base and the light fixture housing, wherein the electric connection is rotatably electrically engaged during the plurality of rotational orientations between the light fixture housing and the mounting base during rotation. In addition, in some embodiments, the light fixture housing and the mounting base is rotational secured in at least one of the plurality of rotational orientations between the light fixture housing and the mounting base.

In addition, in various embodiments, the light fixture housing includes a cam lock and one or more retention members and wherein the mounting base includes an annular groove, and wherein the cam lock and the one or more retention members engage the annular groove. In some embodiments, the cam lock at least rotationally secures the light fixture housing relative to the mounting base in the at least one rotational orientation. In various embodiments, the cam lock axially secures the light fixture housing relative to the mounting base in the at least one rotational orientation. In some embodiments, the one or more retention members axially retain the light fixture housing with the mounting base. In various embodiments, the one or more retention members include a first retention member and a second retention member, wherein the first retention member is different from the second retention member. In some embodiments, the first retention member and the second retention member rotationally and axially engage the annular groove allowing rotation of the light fixture housing relative to the mounting base while maintaining the relative axial position between the light fixture housing and the mounting base, and wherein a first axial removal force to separate the second retention member from the annular groove is less than a second axial removal force to separate the first retention member from the annular groove thereby allowing axial separation of the light fixture housing from the mounting base when the cam lock is disengaged from the annular groove. In various embodiments, the cam lock is on an opposing side of the light fixture housing than the first retention member. In some embodiments, the electrical connection between the mounting base and the light fixture housing includes hot, neutral, and ground connections electrically maintained for 360 degrees of rotation between the mounting base and the light fixture housing. Moreover, in some embodiments, the light fixture housing and the mounting base each include a plurality of electrical contacts rotationally held in electrical contact with the other of the light fixture housing and the mounting base. In various embodiments, the mounting base includes reusable push-in wire connectors to electrically connect to an electrical hot, neutral, and ground wires of the junction box. In some embodiments, the light fixture includes one or more gaskets between the light fixture housing and the mounting base. In addition, in various embodiments, the light fixture may include a cam lock rotationally securing the light fixture housing relative to the mounting base in the at least one rotational orientation and sealing the one or more gaskets between the light fixture housing and the mounting base. In some embodiments, the light fixture housing includes one or more light sources. Moreover, in some embodiments, the light fixture housing includes a depending skirt with one or more retention members projecting inwardly therefrom.

In some embodiments, a method of mounting a rotatable light fixture in a rotational position comprises the steps of providing a mounting base and securing the mounting base to a junction box, providing a light fixture housing, axially engaging the light fixture housing with the mounting base, electrically coupling the light fixture housing with the mounting base, rotating the light fixture housing relative to the mounting base, and/or maintaining the electrically coupling between the light fixture housing and the mounting base during the step of rotating the light fixture housing.

In addition, in various embodiments, method may include rotationally locking the light fixture housing relative to the mounting base. In some embodiments, the method may include electrically coupling the mounting base with the junction box. In various embodiments, the electrically coupling includes using reusable push-in wire connectors. In some embodiments, maintaining the electrically coupling between the light fixture housing and the mounting base includes one or more electrical connections of the light fixture housing having rotational contact with one or more fixed electrical connections of the mounting base during rotation. In various embodiments, axially locking the light fixture housing relative to the mounting base by at least one of one or more retention members and a cam latch. Moreover, in some embodiments, both the one or more retention members and the cam latch axially lock the light fixture housing relative to the mounting base. In various embodiments, the method may include axially disengaging the light fixture housing from the mounting base. In some embodiments, at least one of the one or more retention members includes less axial removal force than another of the one or more retention members when axially disengaging the light fixture housing from the mounting base. In addition, in various embodiments, the method may include disengaging the cam latch.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" or "illumination source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. A given unit may have any one of a variety of mounting arrangements for the light source(s), enclosure/housing arrangements and shapes, and/or electrical and mechanical connection configurations. Additionally, a given unit optionally may be associated with (e.g., include, be coupled to and/or packaged together with) various other components (e.g., control circuitry) relating to the operation of the light source(s). An "LED-based fixture" refers to a lighting unit that includes one or more LED-based light sources as discussed above, alone or in combination with other non-LED-based light sources. A "multi-channel" lighting unit refers to an LED-based and/or non-LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
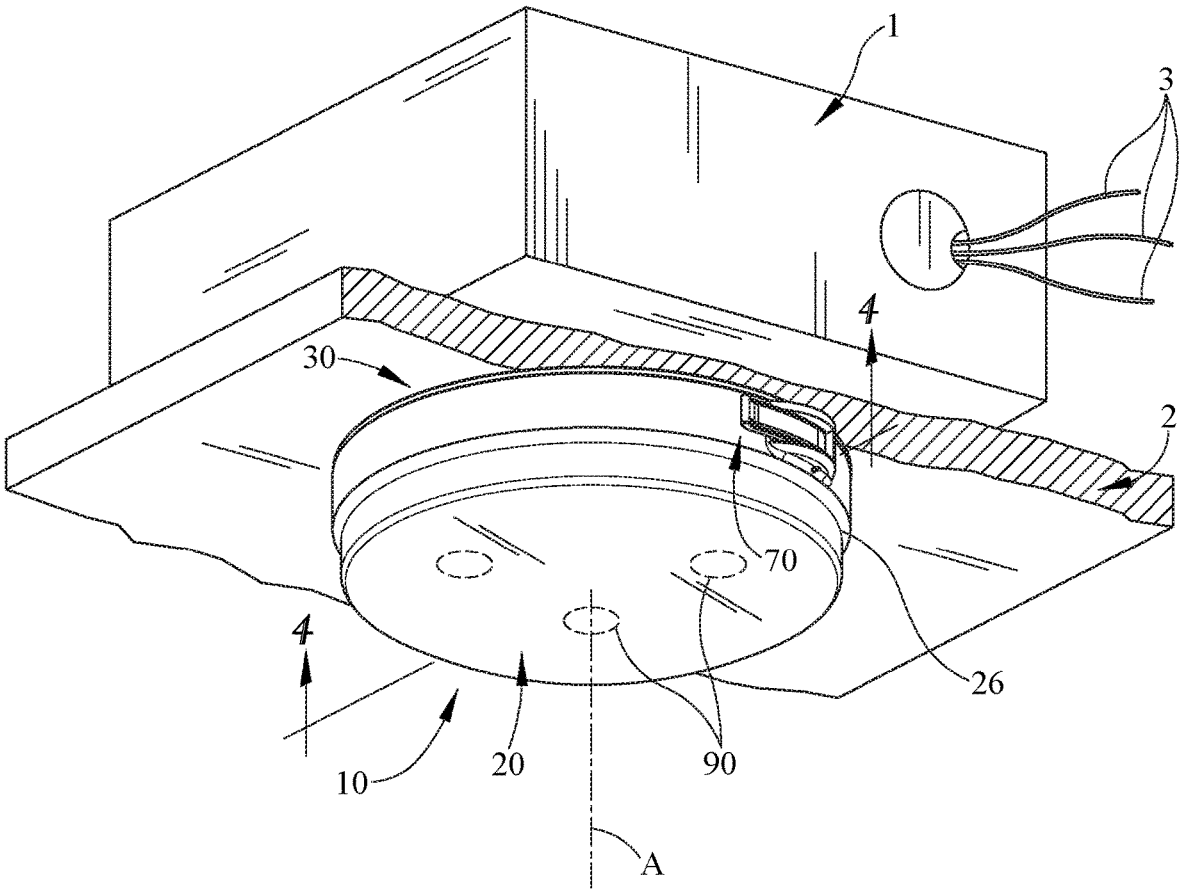
FIG. 1 illustrates a perspective view of an implementation of the light fixture described herein secured to a junction box in a ceiling mount application.

It is to be understood that a light fixture is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Turning to the Figures, FIGS. 1-4 illustrates an example of a light fixture 10 described herein wherein the base is electrically energized from the junction box and provides electrical power to the light fixture via rotational quick connect electrical contacts thereby allowing the luminaire/electrical fixture to be wired without traditional wiring techniques. Included in one implementation is a light fixture housing 20 and a mounting plate or base 30. In some embodiments, one or more light fixture housings 20 may be used on the same or universal mounting base 30. The light fixture housing 20 may include a variety of one or more light sources 90 (e.g. LEDs). The light sources and/or LEDs of the light fixture may be powered by the electrical connectivity between the light fixture housing and the base. Control electronics such as one or more LED drivers and an integrated or individual LED light controller may also be implemented in the light fixture in order to control the LEDs, modify light output, control color temperature and or brightness, among other light output characteristics. Such modification of light output characteristics may be implemented by modulation techniques including pulse width modulation, frequency modulation, amplitude modulation, embedded pulse code modulation for data inclusion, as well as others and combinations thereof. The controller and/or driver for the LEDs may be integrated into a single electronic circuit and/or control processor are not necessarily required to be separated or integrated as either may be implemented, alone or in a combined configuration to control the light output of the LEDs. The respective modulated pulses from the driver, drivers, and/or controllers as well as possibly the baseline currents output by the driver circuits may be independently controlled by higher level logic of a system controller. In a digital controller example, such logic may be implemented by a programmable microcontroller, although those skilled in the art will recognize that the logic could take other forms, such as discrete logic components, an application specific integrated circuit (ASIC), etc.

The mounting base 30 may be electrically coupled to a junction box 1 on a ceiling 2, wall, or other structure. The light fixture housing 20 may rotate relative to the installed orientation of the mounting base 30 allowing the initial orientation of the junction box 1 and/or mounting base 30 to not limit the orientation of the subsequently attached light fixture housing 20. Additionally, the interface between the light fixture 20 and the mounting base does not require direct installation wiring and electrical connection and power for the fixture is supplied through the rotational quick connect construction. Further, the coupling of the light fixture housing 20 and mounting base 30 may allow adjustments to the rotation, mounting, and aiming of the fixture without breaking the electrical contact from the junction box 1 and/or connecting base 30.

Figure 3:
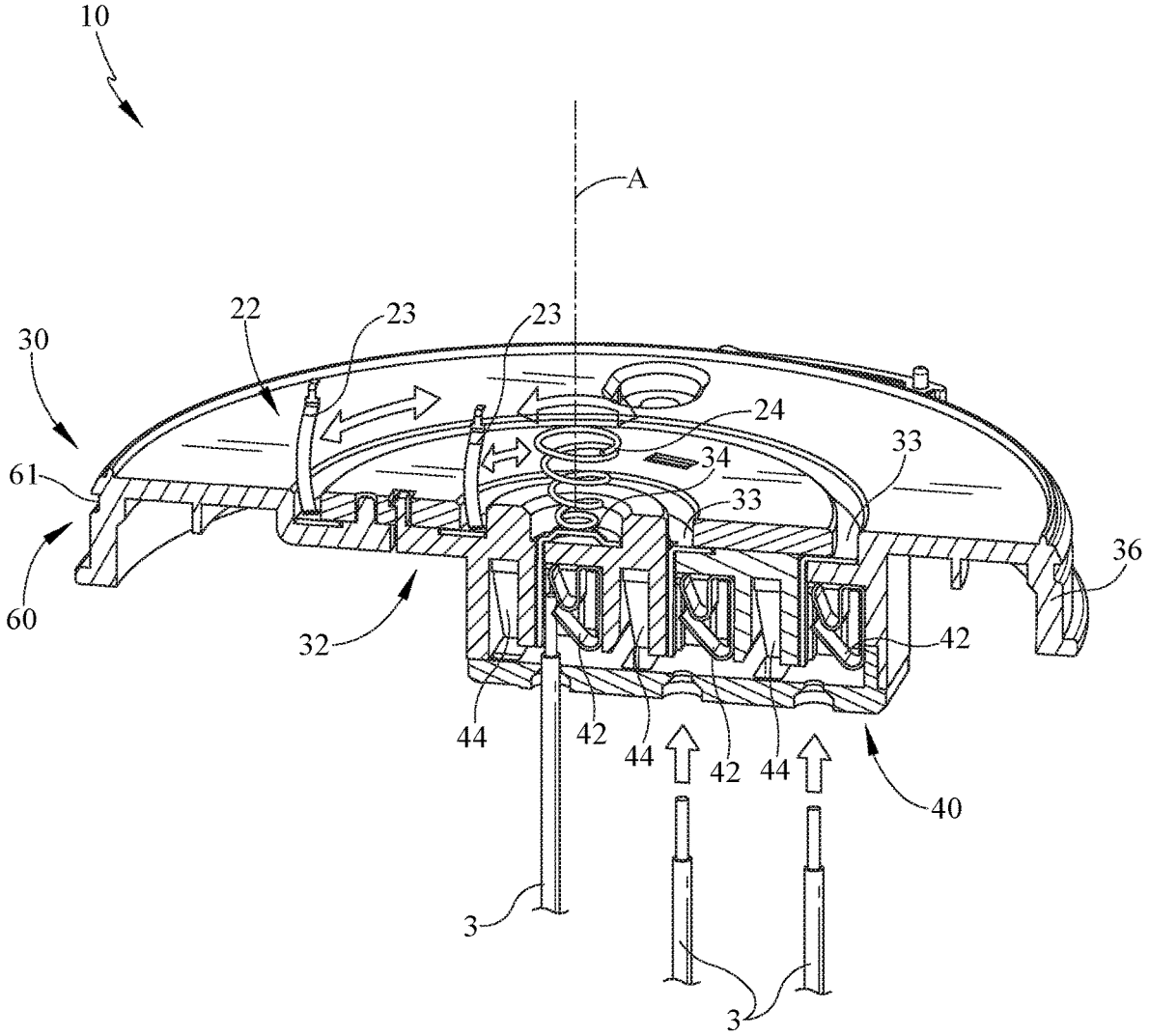
FIG. 3 illustrates a sectional view of the mounting base of FIG. 2 described herein illustrating the wires being engaged into the reusable push-in wire connectors and the connectors of the light fixture housing engaging the connectors in one rotational position with the remaining portions of the light fixture housing removed.

Multiple implementations may be appreciated for electrically connecting the mounting base 30 to the associated junction box 1 which provides power. In some implementations, the mounting base 30 may be hard wired directly to the hot, neutral and ground connections to the junction box. In other implementations, the junction box and the mounting base may be connected by quick connect mechanical connectors. In one of the examples and implementations, as is shown in FIGS. 1 and 3, the wires 3 (e.g. hot, neutral, and ground) may utilize reusable push-in wire connectors 40 to electrically connect the mounting base 30/connectors 32 to the junction box 1. The implementation of quick connect devices may reduce or eliminate the requirement of one or more tools needed for wiring the 120V AC wires 3 with the mounting base 30. The wires 3 are held in tension by tensioned springs 42 and may be disengaged by releasing the tension via the corresponding release members/wedges 44. Although one method and apparatus is shown for connecting wires 3 to the mounting base 30, it should be understood that a variety of wire connectors and methods may be used to electrically connect the connectors 32 of the mounting base 30 to the wires 3. Further, the use of the quick connect features and mechanical interfaces described allow light fixtures to be connected to a base without the requirement of wiring the light fixture by the user. Thus, upon replacing the light fixture, utilization of the disclosed interface allows the owner to disconnect and connect different light fixture without the necessity of wiring changes or electrical connectivity apart from simply installing the light fixture rotationally.

Figure 4:
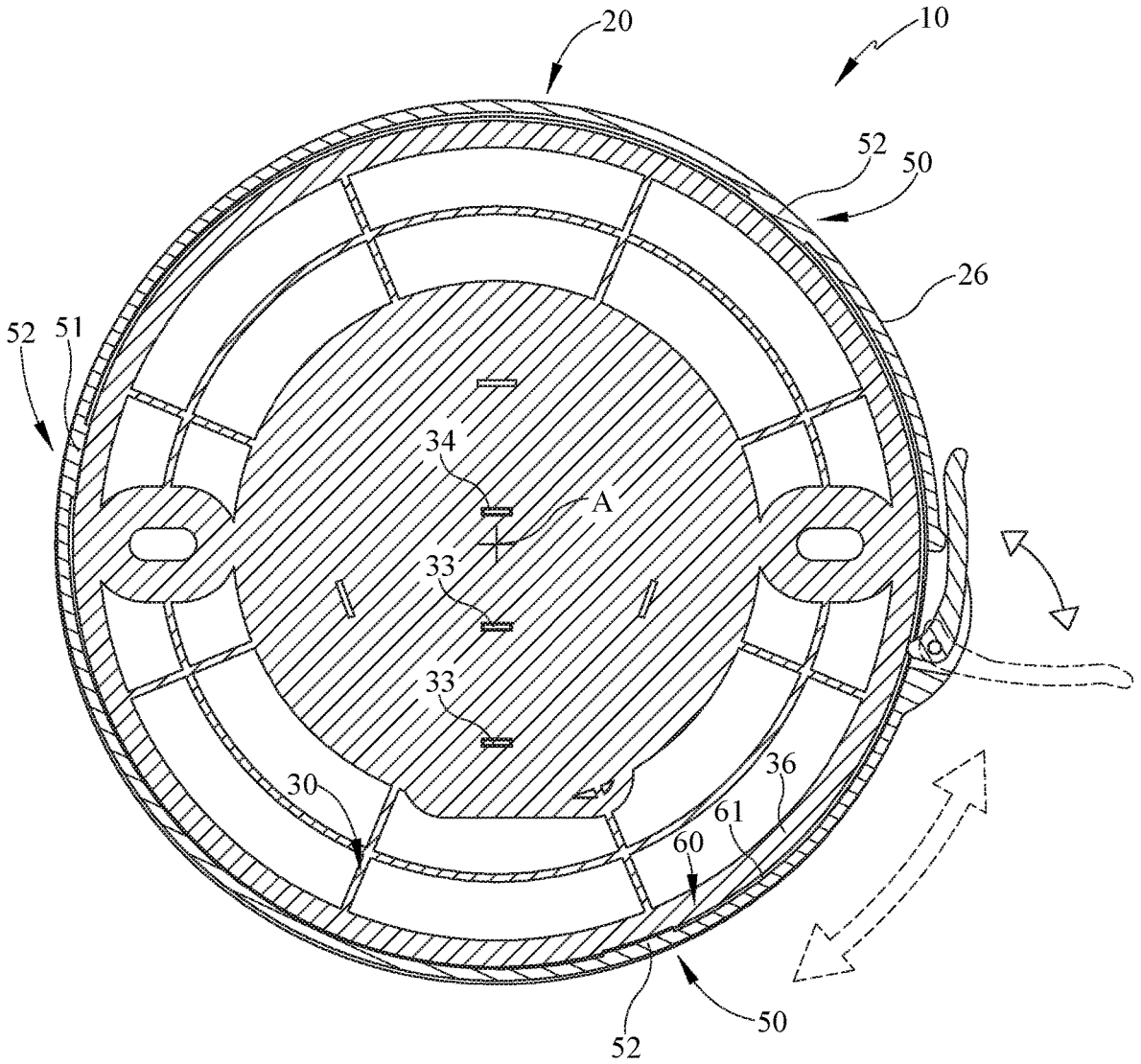
FIG. 4 illustrates a sectional view of a light fixture of FIG. 1 described herein taken along line 4-4, with the rotational lock shown in an engaged position in solid lines and a disengaged position in broken lines.
Figure 5:
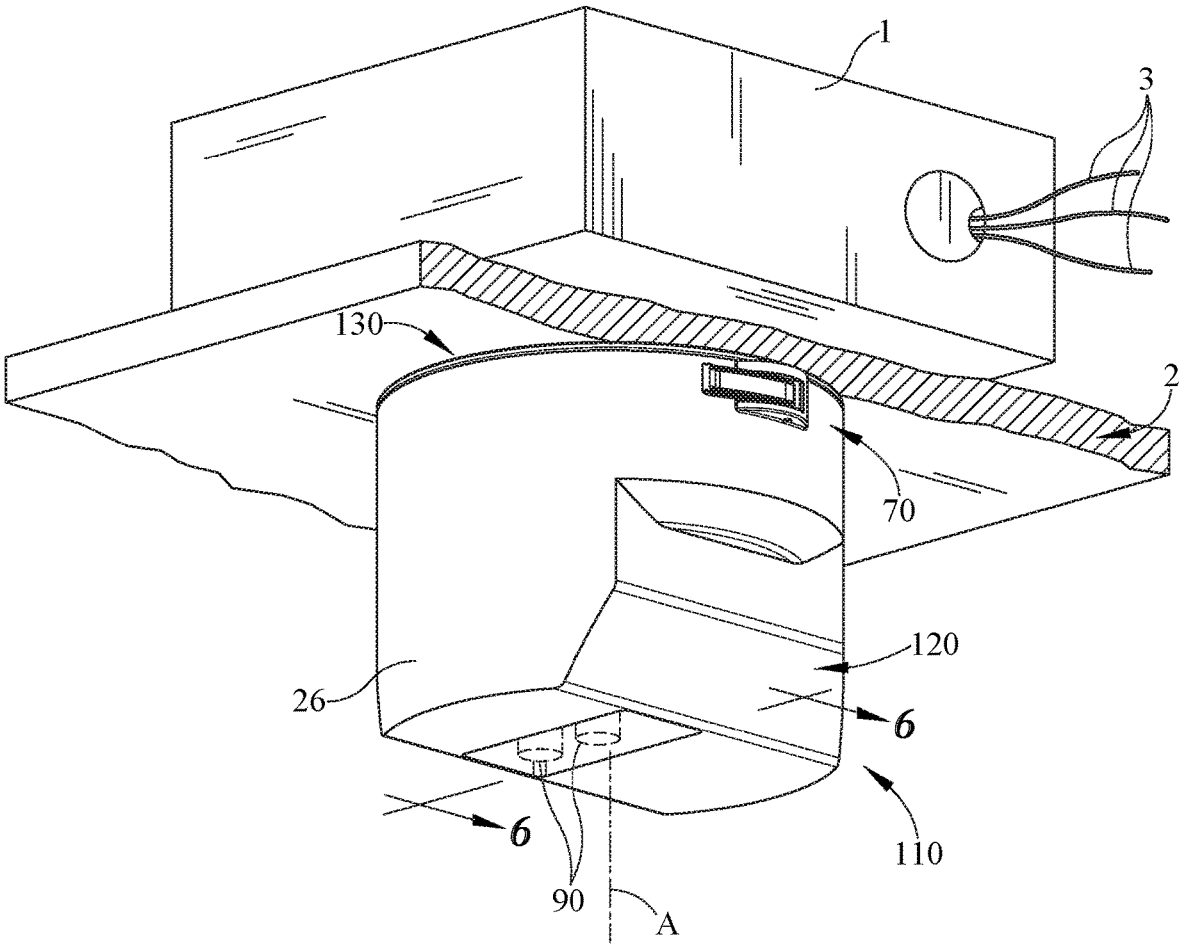
FIG. 5 illustrates a perspective view of another embodiment of an implementation of the light fixture described herein.

The light fixture housing 20 may maintain rotationally exposed electrical connection to the mounting base 30 during rotation and between rotational orientations/adjustments. When assembled, the light fixture housing 20 may be electrically coupled regardless of the rotational orientation of the light fixture housing 20 relative to the mounting base 30. As such, the ground, neutral, and hot connections 32 may be electrically maintained for 360 degrees of rotation (e.g. CW and/or CCW) about an axis A. The electrical contacts/connectors 22 of the light fixture housing 20 may be mechanically and electrically coupled to the electrical contacts/connectors 32 of the mounting base 30 when assembled and/or locked in rotational position as shown in FIGS. 1 and 4.

Figure 6:
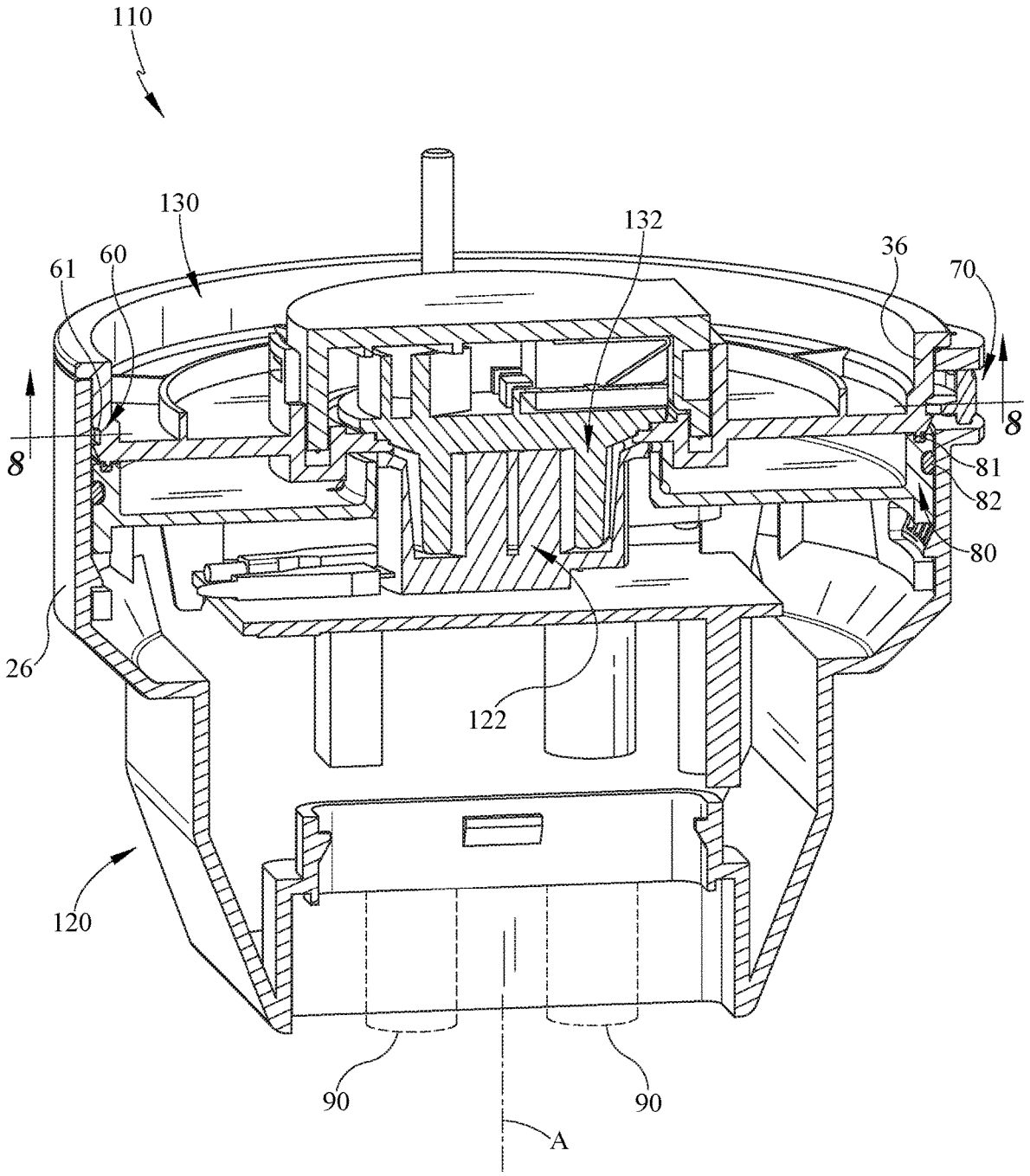
FIG. 6 illustrates a sectional view of the light fixture of FIG. 5 taken along line 6-6.

The electrical contacts or connections 32, 22 between the mounting base 30 and the light fixture housing 20 may be rotatably electrically engaged during the rotation (e.g. in the plurality of rotational orientations of the light fixture housing in respect to the base). As shown in FIGS. 3 and 6, the one or more electrical connections 22, 122 of the light fixture housing 20, 120 each have rotational contact with the one or more respective electrical connections 32, 132 of the mounting base 30. 130. The one or more contacts 22 of the light fixture housing 20 rotates with the housing and maintains the contact (e.g. axial and/or radial contact, etc. for 360 degrees contact about the axis A) with the fixed connections 32 of the mounting base 30. Stated alternatively, the one or more engaging contacts 22 may be rotationally held in electrical contact with the other corresponding contacts 32 at the base during any point of the rotation. Thus, in some implementations, the rotatable light fixture housing 20 may be in rotational connection with the base 30 wherein electrical connectivity between the light fixture 20 and the base 30 is maintained during all points of rotation. In other embodiments, rotational connectivity may be maintained only during a predefined rotational extent wherein the light fixture housing 20 is energized at recognized rotational points relative to the base 30 while at other points during the rotational extent relative to the two the electrical connections may be interrupted. Similar aspects and features may be implemented in a rotatable electrical plug connection as well.

Figure 2:
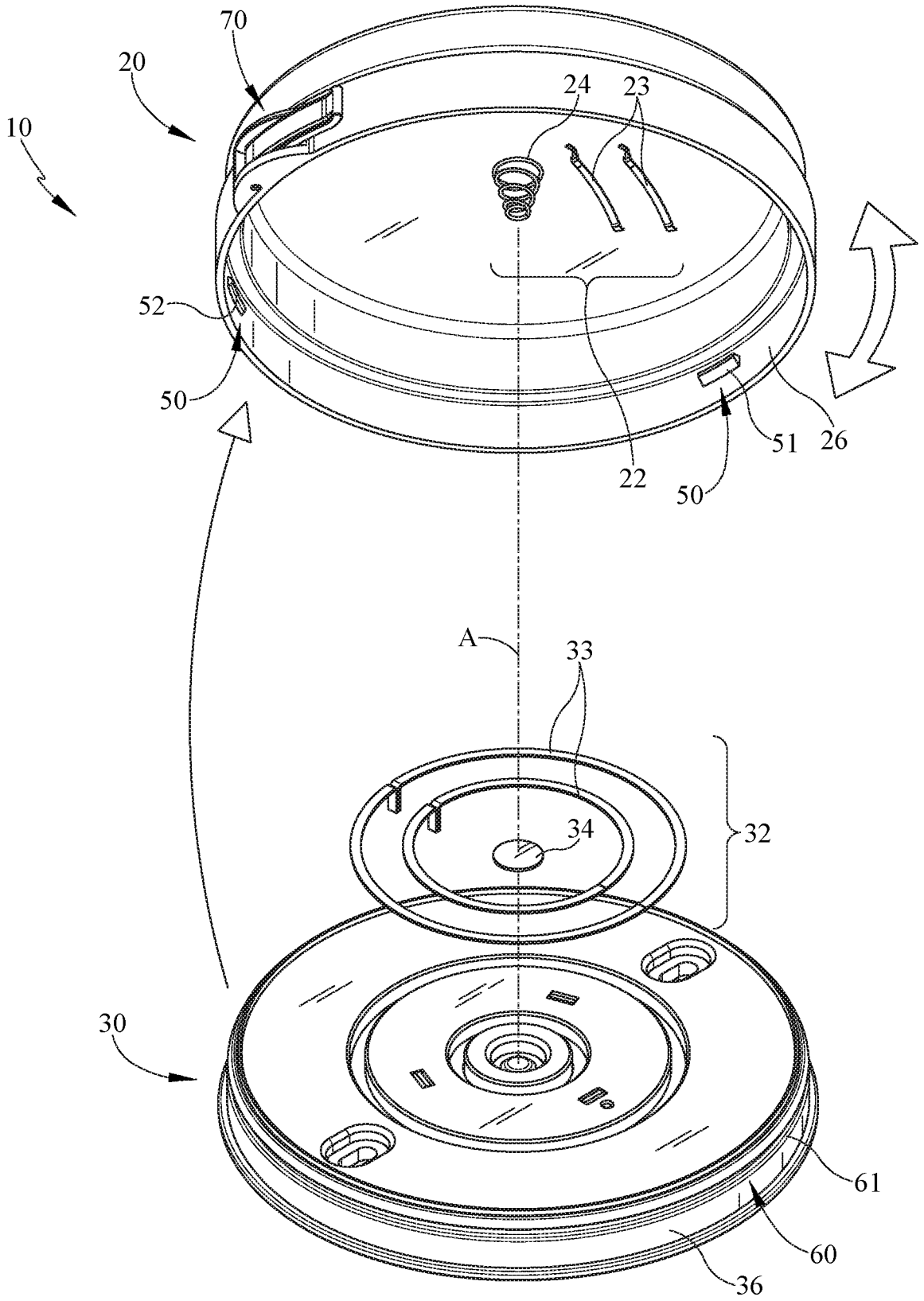
FIG. 2 illustrates a perspective view of the rotatable light fixture housing and housing electrical connectors exploded away from the mounting base and base electrical connectors of FIG. 1.

For example, in the embodiment shown in FIGS. 1-4, the light fixture housing 20 includes a pair of tensioned leaf springs or brushes 23 engaging concentric annular rings 33 (e.g. hot and neutral) of the mounting base 30, while a third located coil spring 24 may be used for ground with a corresponding third located disc 34 of the mounting base 30. In such embodiment, the leaf springs or brushes 23 maintain electrical connectivity to the energized concentric annular rings 33 during the entire rotational extent of the fixture 20 relative to the base 30 while the rings 33 are continually in electrical connectivity to respective hot, neutral and ground wiring from the junction box. In the example of FIG. 2, the annular rings 33 and disc 34 are directly connected to respective hot, neutral and ground connections from the junction box. Upon installation of the fixture 20 onto the base 30, leaf springs 23 engage the respective annular ring 33 and are thereby electrically connected to the respective line of the junction box without the user having to wire the light fixture. Spring 24 or other similar engagement surface, tab, contact or spring can be electrically connected to the disc 34. Spring 24 and springs 23 for example as depicted in the embodiment of the figure, could allow for not only continued engagement around a rotational extent of engagement between the structures but also elevational differences thereby maintaining electrical connectivity at differing connection heights between the two structures 20, 30.

In various constructions, the plurality of rings 33 of the mounting base may be installed within a corresponding number of annular extending grooves formed within the base to fixedly retain the rings therein. Further, the disc 34 may be optionally centrally positioned within the annular grooves and the annular rings within a recess formed in the base 30. The recess and annular grooves form a mechanism to positionally retain both the annular rings and the disc within the base.

Alternative constructions maintaining electrical connectivity between the housing 20 and the base 30 may be utilized which minimize the exposed surface of the wiring. For example, the embodiment of the light fixture 110 shown in FIGS. 5-8, includes the rotatable connection/contacts 122, 132 there between utilizing a different mechanical interface. The electrical connection 122/132 include a mating male/female rotational plug with annular rings/pins/contact members maintaining electrical contact during relative rotation and/or rotational position. As shown in the embodiments, the electrical contacts or conductive rings of the mounting base 30, 130 are recessed within surrounding structure (e.g. top face, plug, etc.) and may reduce exposed wiring and/or contacts from the user. Further, as shown in the embodiment of light fixture housing 120 FIGS. 6 and 7, the connections 122 may also be recessed.

Rotatable plug 132 which enters into receptacle 122 allows for electrical connectivity between the fixture and the base while preventing the necessity of actual wiring of the fixture. Further, in the various examples, electrical connectivity between the base and the electrical fixture may be maintained and be rotationally exposed about the entire 360 degrees of rotation there between. Thus, in some examples and implementations, the base 130 may include electrical contacts on a first and second surface of the annular ring of the base. The electrical contacts can be either on an upper surface or on a side surface one of the annular rings depicted in this one of several embodiments. For example, annular rings may be located along either a top surface of a wall on the base or along an interior or exterior wall surface. Each such annular ring may be rotationally exposed for connectivity by an engaging leaf spring or contact surface from a mating light fixture along an entire rotational extent between the fixture and mounting base. Alternatively, the rotational connectivity may be limited in radial extent or include electrically connected and disconnected radial positions.

Figure 7:
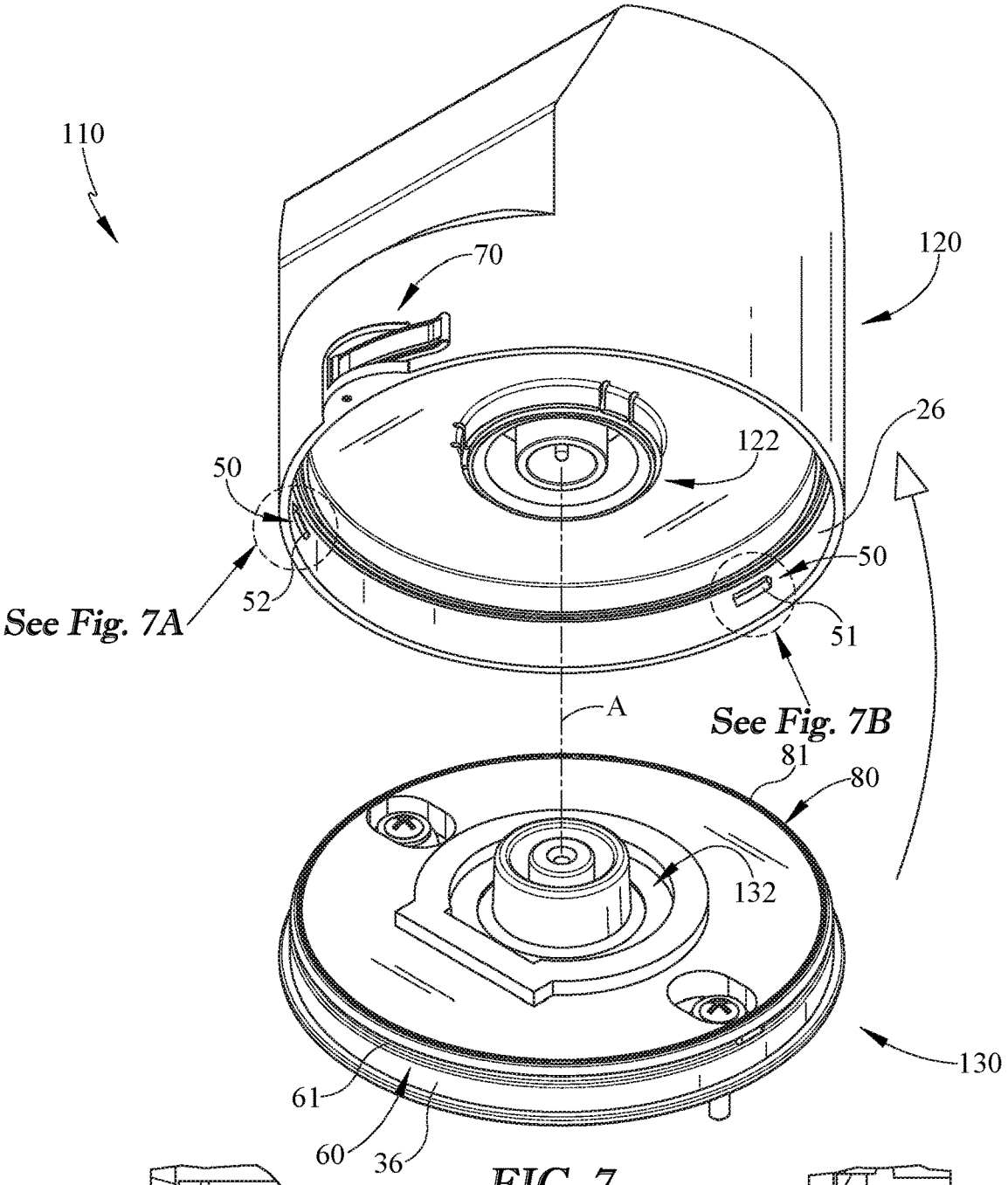
FIG. 7 illustrates a perspective view of the light fixture housing exploded away from the mounting base of FIG. 5.

For example, annular walls may be utilized in FIG. 7 wherein walls formed on the base 130 telescope into annular walls formed on the light fixture 120 such that they plug into each other. Electrical connection may be achieved by the various implementations of rings and opposing and opposing rings or metal springs which contact opposing rings. Such opposing electrically conductive surfaces may be frictionally engaged between each other by virtue of the angled nature of the interfacing walls or a combination of spring leafs or outwardly extending contacts may be utilized with the opposing rings. Such variations may be used on either side of the electrical interface so long as, in some embodiments, electrical contact is maintained during the full rotational engagement between the light fixture 120 and the base 130.

A central post receiving receptacle could be provided in the base to receive a mating electrical contact from the light fixture 120 while also working in conjunction with additional contacts in the rotational plug. In some embodiments, opposite orientation structures could be provided such as providing the post receiving receptacle on the other structure and/or in combination with annular contact surfaces receiving and contacting electrical contacts on the annual surface of either of the base and light fixture. It should be understood a variety of rotatable electrical connections/couplings may be used between the light fixture housing and the mounting base and still be within the scope of the invention.

In some implementations, the light fixture housing may be rotational secured in at least one rotational orientation relative to the mounting base. In the embodiments shown, a cam lock or latch may be used to lock or fix the rotational position. When in a disengaged position as shown in broken lines in FIGS. 4 and 8, the rotational lock (e.g. cam lock) allows the light fixture housing 20, 120 to rotate about the axis A/mounting base 30, 130. Although the cam lock is shown in the embodiments, it should be understood that a variety of one or more locking mechanisms may be used to fix the relative rotation between the housing and the mounting base. For example, screws which enter into the side of the fixture and which contact the base to maintain relative position between the two may be utilized. As well, for example, rotational stop-locks with threads engaging between the two structures, engagement lugs which engage at specific rotational positions, push and turn engagement structures between the base and the housing 20/120 may also varyingly be implemented.

In some embodiments, the light fixture 10, 110 may include a variety of water proofing features to reduce the flow of water into the light fixture and/or internally between structures of the components. Weather proofing and water proofing between the light fixture and the base may prevent moisture intrusion into the electrical connectivity and interface area providing electrical connection and power to the light fixture. Moisture intrusion into such areas could potentially cause corrosion or other issues related to the exposed electrical connecting structures. Various water prevention structures can be implemented in the interface areas between the two structures.

Figure 7A:
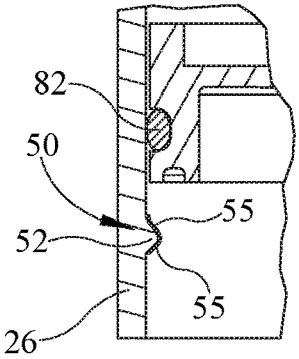
FIG. 7A illustrates an enlarged sectional view of the first retention member of the light fixture housing described herein.
Figure 7B:
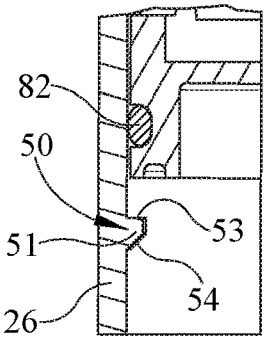
FIG. 7B illustrates an enlarged sectional view of the second retention member of the light fixture housing described herein.

For example, one or more seals or gaskets 80 may be used between the light fixture housing 20 and the mounting base 30. As shown in FIG. 6, one or more gaskets or O-rings 81 may be positioned between the light fixture housing and the mounting base. The gasket 81 may be outside the periphery of the electrical rotatable connection 122, 132 between the light fixture housing 120 and the mounting base 130 to reduce water from entering towards the electrical coupling. The gasket 81 is shown attached to the mounting base, however the gasket 81 may be coupled to the light fixture housing in some embodiments. Internally within the housing 120 and/or base 130 may be one or more gaskets 82 as well. As shown in FIGS. 6, 7A, and 7B, another O-ring 82 may be used within the light fixture housing 120 to seal the electrical components within one or more internal compartments. Further, screws or other fasteners may also include gaskets to seal their corresponding openings.

In some embodiments, one or more structures of the light fixture housing and/or mounting base may axially and/or rotationally engage each other to allow relative rotation and/or energizing of the light fixture housing. Alternatively, or in combination with the light fixture structure, the user may need to axially and/or rotationally maintain the light fixture housing with the mounting base until the rotational orientation is fixed.

Figure 8:
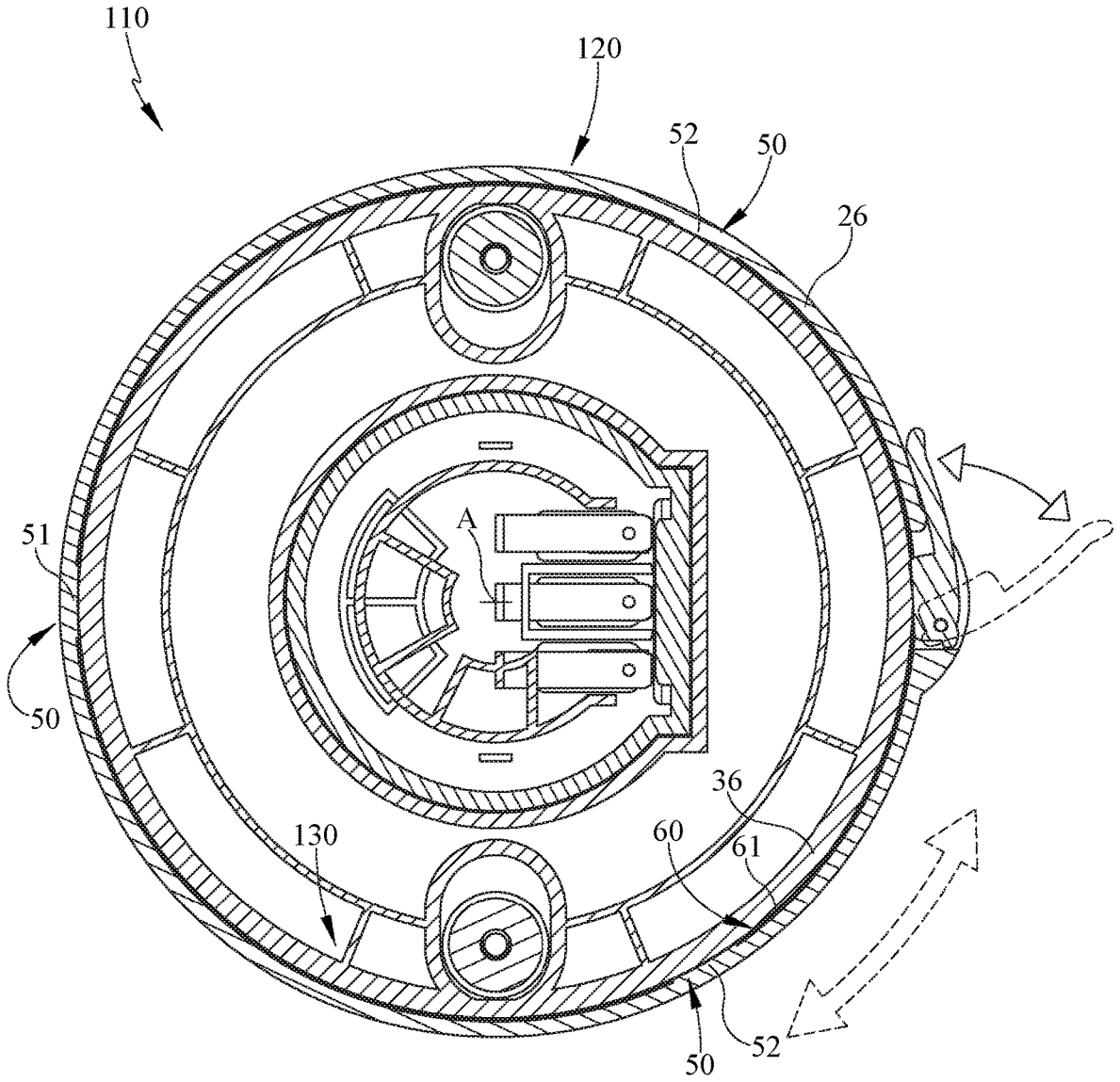
FIG. 8 illustrates a sectional view of a light fixture of FIG. 6 taken along line 8-8, with the rotational lock shown in an engaged position in solid lines and a disengaged position in broken lines.

With the light fixture housing 20 assembled with the mounting base 30, the electrical connection 22, 32 may be engaged/energized. In some embodiments as shown in FIGS. 4 and 8, one or more retention members 50 may be used to axially retain the light fixture housing with the mounting base. The retention members 50 may also allow for relative rotation between the light fixture housing and the mounting base. The retention member 50 may be received within one or more receivers 60 of the mounting base 30. In the embodiments shown in the Figures, the one or more retention members 50 (e.g. lugs, taps, projections, dimples) project inwardly from a depending skirt 26 of the light fixture housing 20. When assembled, the light fixture housing skirt 26 overlaps a sidewall or skirt 36 of the mounting base 30. The mounting base 30, in the embodiments shown, includes the receiver 60 in the skirt 36. In the embodiment show, the receiver 60 may be an annular groove 61. The one or more retention members 50 axial engage the mounting base annular groove 61 thereby axially locking the base 30/light fixture housing 20. This may allow the user to have hands free axial retention until rotation of the light fixture housing 20 is needed, if any. The one or more retention members 50 may travel 360 degrees or a portion thereof within the receiver 60 and/or groove 61 allowing the rotation of the light fixture housing 20 relative to the mounting base 30. Although the groove 61/receiver 60 is shown as a continuous groove about the outer periphery of the skirt 36, it should be understood that the receiver may be a variety of quantities, sizes, locations, shapes, and constructions and still be within the scope of the invention. In some embodiments, a rotational lock 70 and the one or more retention members 50 may axial secure the light fixture housing 20 with the mounting base 30, each of which acting as a mechanical locking mechanism. The one or more retention members 50 may releasable engage (e.g. axial disengagement) from the annular groove allowing replacements, repair, or attaching a different style fixture housing, etc. Further, in some embodiments, the one or more retention members 50 may allow the user to identify that the engagement (e.g. axial) between the base 30 and fixture 20 has been reached and/or disengaged by creating a characteristic identified by the user such as, but is not limited to, an audible click, visual identification, feel, marked rotational position identifiers, etc. Although the retention members are shown as an arcuate projecting tab and the annular groove is shown with an arcuate profile, it should be understood that the retention member/groove may be different in shape, size, quantity, position, and construction. Moreover, for example, the axial/rotational structural engagement may be incorporated in either housing/base. For example, the one or more retention members 50 may be placed on either the light housing or the base with the associated receiver 60 and/or groove 61 positioned on the opposing interfacing structure. Moreover, for example, the axial/rotational structure engagement may be incorporated in either light housing or the base and be interchangeable between the two opposing surfaces in various shapes, sizes, quantity, position and construction in either housing/base.

For example, in some embodiments, the rotational locking mechanism 70 (e.g. cam latch) may be used, alone or in combination with other structure (e.g. retention members), to axially and/or rotationally fix the light fixture housing to the mounting base. The cam latch/rotational lock 70 may be used to axially and/or rotationally fixate the light fixture housing with the mounting base. For example, the one or more rotational locks 70 (e.g. cam lock) may partially be inserted into an annular groove 61 in the outer periphery of the mounting base skirt 36 allowing axial retention while being able to rotate of the light fixture housing until the user decides to fully engage the cam latch to fix the rotational orientation. If no retention members are used, one or more rotational locks may be used alone to lock the axial and rotational position of the light fixture housing.

In some implementations, the one or more retention members 50 may include one or more different retention members. The one or more retention members 50 may be different in shape, size, quantity, position, and construction. For example, as shown in FIGS. 2, 4, 7, 7A, 7B, and 8 the retention members may include at least two different retention members to aid in separation/engagement of the light fixture housing with the mounting base. Alternatively, stated a first retention member 51 may be considered a "hard stop" and a second retention member 52 may be considered a "soft stop". The second retention member 52 may maintain axial rotation/axial engagement but allow for removal/attachment to the groove. The first retention member 51 may be used in combination with the rotational locking mechanism 70 to secure the rotational position and/or engage the sealing function of the one or more gaskets 80 and/or maintain axial rotation/axial engagement. The second retention member 52 may assist the user in removing/attaching the light fixture housing 20 from the axial and/or rotational engagement. For example, the first retention member 51 may be unable to disengage from the groove 61 unless the second retention member 52 disengages first. Further in some embodiments, the first retention member 51 may need to be axial engaged with the groove 61 first before the second retention member 52. In some embodiments, the second retention member 52 may require less axial removal force than the first retention member.

As shown in the embodiments in FIGS. 2, 4, 7, 7B, and 8 the first retention member 51 may be positioned on an opposing side of the rotational lock 70. This may balance the forces to secure the engagement between the fixture and base. As shown in FIGS. 2, 4, 7, 7B, and 8, the first retention member 51 may include a flat shelf top 53 in the direction opposite of the free edge of the skirt 26 of the light fixture housing 20 opposite a tapered edge 54. As shown in the embodiments in FIGS. 2, 4, 7, 7A, and 8, the second retention member 52 may be positioned adjacent the rotational lock 70. The second retention members 52 may include opposing rounded edges 55 on the top and bottom of the tab or member. The rounded edges 55 of the second retention member 52 may allow for easier removal/engagement (e.g. less removal axial force) than the first retention member 51. It should be understood that the one or more first and/or second retention members may be in a variety of locations, shapes, sizes, constructions, and quantities.

In use, a user may insert the 120V AC wires 3, projecting from the junction box 1, into the reusable push-in wire connectors 40 on the bottom of the mounting base 30. The user may then mount the mounting base 30 to the junction box 1 with one or more fasteners. The light fixture housing 20 may then be engaged (e.g. axially) with the mounting base 30 without the need to handle wires or engage in wiring of a wiring interface between the base and the light fixture. In some embodiments, when axially engaged the one or more retention members 50 and/or rotational lock 70 may engage the annular groove 61 of the mounting base 30 thereby coupling the light fixture housing 20 with the mounting base 30 and/or the electrical connections 22, 32 therebetween. A characteristic of the correct engagement therebetween may be identified by the user such as an audible/visual indicator. With the one or more retention members 50, if used, engaged with the receivers 60/annular groove 61, the light fixture housing 20 is engaged (e.g. axially) such that the user may freely rotate the light fixture housing 20 relative to the fixed mounting base 30. Moreover, the light source/light fixture housing 20 may maintain the electrical coupling between the light fixture housing and the mounting base during the rotation of the light fixture housing. The user may rotate the light fixture housing to aim, orient features of the light fixture, etc. as desired by the application or user. Once the desired rotational orientation is achieved, the user may lock the rotational orientation via the cam lock or rotational lock/fastener 70. Subsequent rotational adjustments may be made merely by temporarily disengaging the rotational lock. Further, the user may desire to change to a different light fixture housing and still utilize the mounting base, make repairs, or change light sources by disengaging the light fixture housing.

Moreover in some embodiments, if the one or more retention members 50, receivers 60, and/or rotational lock 70 are not used to engage (e.g. axially) the mounting base 30, the user may have to hold the light fixture housing 20 to the mounting base 30 while rotating into position or merely orientate before axial engagement before fixing the rotational orientation with the rotational lock 70.

Figure 9:
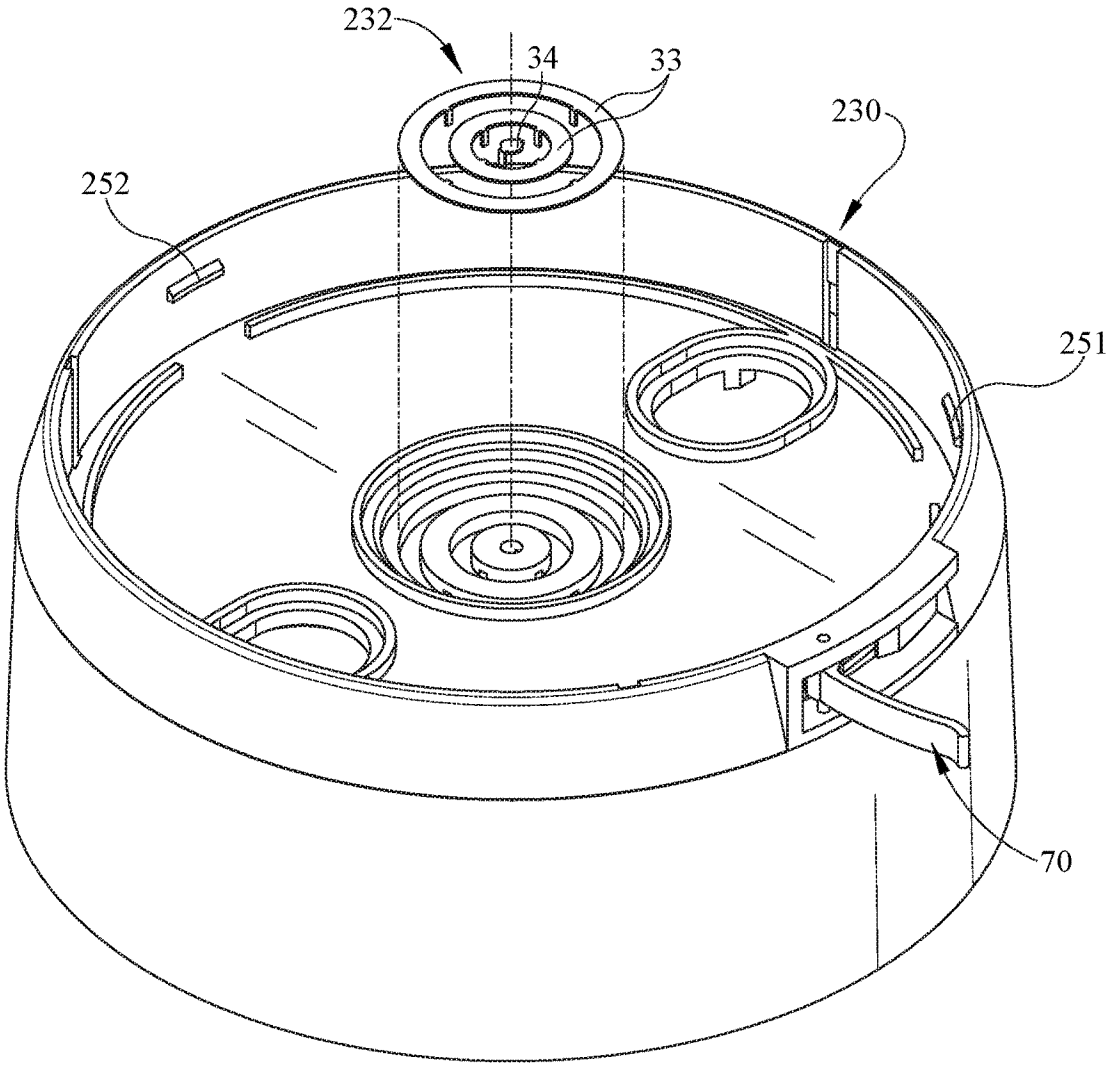
FIG. 9 illustrates a perspective view of another embodiment of the mounting base wherein the electrical connectors are exposed.
Figures 14, 14A:
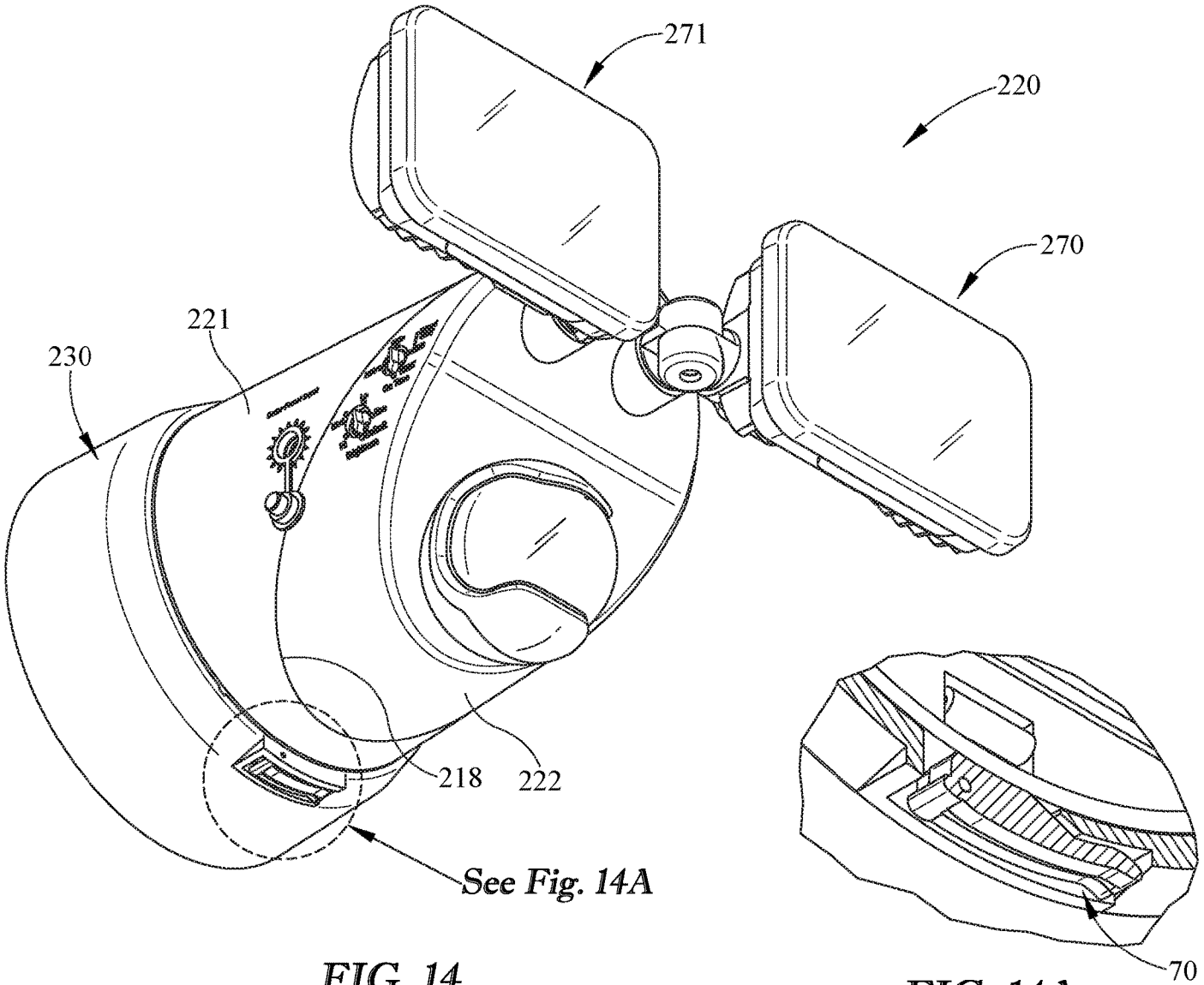
FIGS. 14 and 14A illustrates the combined light fixture housing and mounting base of FIG. 12 combined with a close up of the locking mechanism depicted in FIG. 14A.

Turning to FIG. 9, another version of the mounting base 230 described and supported by the present application is depicted. As with mounting base 30, the mounting base 230 includes similar electrical contacts 232 with a central electrical disc or connection 34 and first and second surrounding annular connections 34. These electrical contacts 232 may be positioned within recessed areas of the base but remain exposed for electrical connectivity by a light fixture housing, such as light fixture housing 220 of FIG. 10. The electrical contacts 232, as with electrical contacts 32, allow continued electrical connectivity during rotation between the mounting base 230 and a light fixture housing. The mounting base 230 may include previously recited structures such as retention members 251, 252 positioned on an inner sidewall for interfacing engagement with similarly positioned engagement structure on the outer wall of the light fixture housing 220. In the example of FIG. 9, the mounting base 230 may also include a similar locking mechanism 70. The locking mechanism may be a mechanical locking mechanism, such as a cam lock or alternatively retention tabs, or may be other type of locking mechanisms utilizing magnets or other retention features to engage and/or retain the mounting base 230 to the inserted light fixture housing. For example, the mechanism 70 shown in FIG. 14A could be replaced with a magnet which associates with a surface or alternative magnet in the light fixture housing. In other examples, the retention members 251, 252 could also be replaced with other tabs or magnets to similarly provide mechanical locking of the light fixture housing with the mounting base. Any of these may be used singularly or in any combination.

In some examples, the electrical contacts 232 of the mounting base 230 may be annular contacts and positioned in annular recesses formed in the mounting base, similar to receiving recesses containing the electrical contact rings 33 of the various embodiments. In alternative constructions, the contacts may be partially annular, interrupted contacts or singular partially annular, similar to those identified for contact rings 33. For example, in some implementations instead of an annular ring allowing for 360 degrees of rotational connectivity, partial rotational electrical contact may be maintained for rotation of the two structures, the mounting base and the light fixture housing, for about 90 degrees or less. In even further implementations, the electrical contacts may be positioned to electrically connect only for a predetermined extent allowing for non-electrical contact to be allowed for additional rotation.

Figure 10:
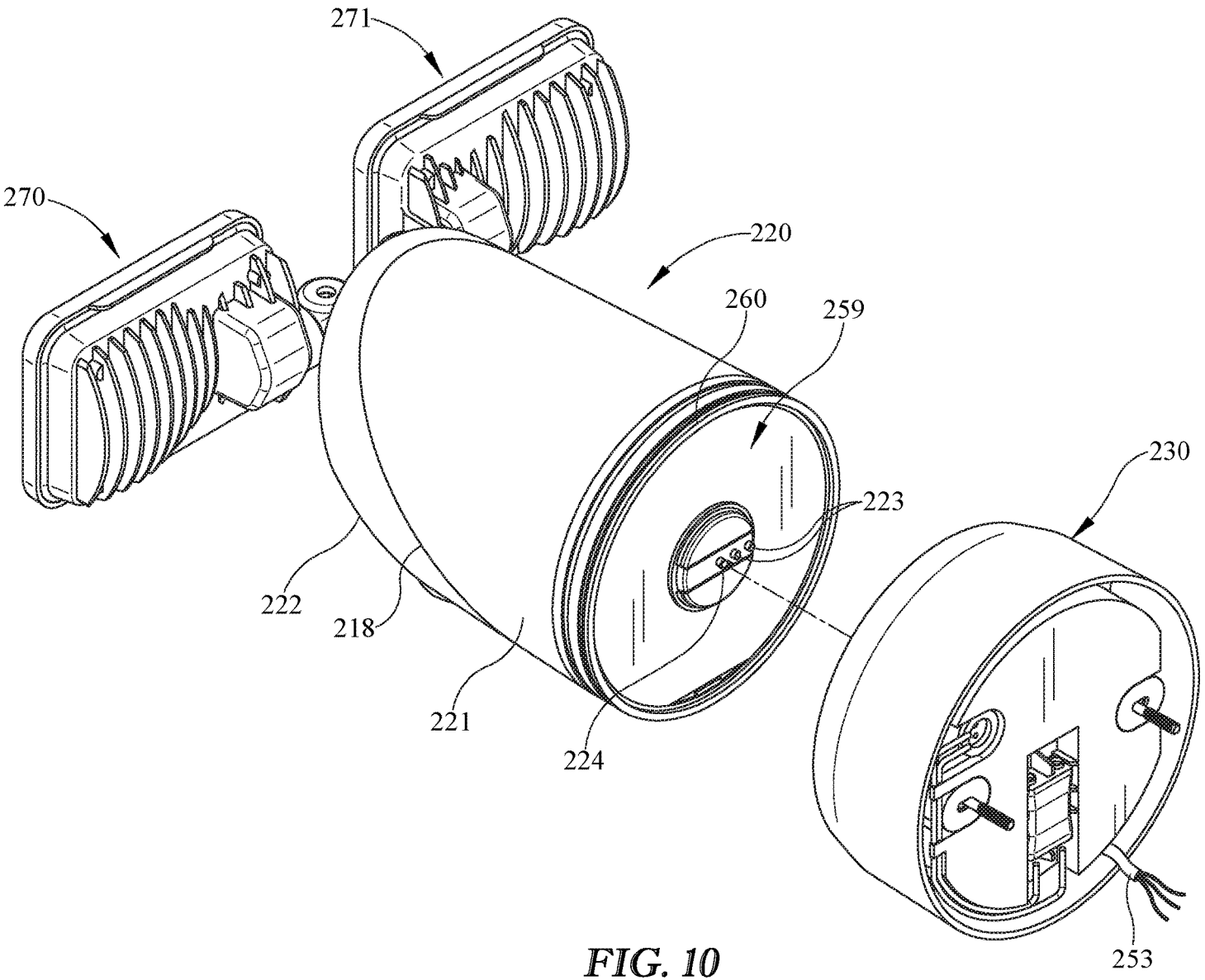
FIG. 10 illustrates a perspective view of another embodiment of a light fixture housing positioned away from the mounting base of FIG. 9.

FIG. 10 depicts the mounting base 230 from FIG. 9 along with a light fixture housing 220 in the form of a security light. The light fixture housing 220 connects to the electrical contacts 232 at the mounting base 230 similar to the light fixture housing 20 and 120. Light fixture housing contacts 223 and center contact 224 engage exposed contacts 33 and 34 of the mounting base 230 such that electrical contacts 232 provide rotational electrical connectivity. In other words, during rotation and non-aligned attachment of the light fixture housing 220 onto the mounting base 230 electrical connectivity is maintained. For example, contacts 223 and 224 may be leaf springs, biasing pins, electrical surfaces or other structures which allow electrical connectivity between the light fixture housing and the electrical contacts on the mounting base. For example, pins 223, 224 may be utilized such placement of the light fixture housing 220 within the mounting base 230 electrically connects the pings to the contacts 232. As well, light fixture housing 220, similar to light fixture housings 20 and 120, maintain connection to the base using a receiver/groove 260 which interfaces with the retention members 251, 252 in the mounting base 230. Receiver 260 may be an annular groove or other recess which aligns and receives the retention members 251, 252. Locking mechanism 70, in the form of a cam latch or rotational latch, may provide a resistance fit or force against the outer side wall of the interfacing portion of the light fixture 220 adjacent receiver 260 to fixate the mounting base 230 with the light fixture housing 220.

Figure 11:
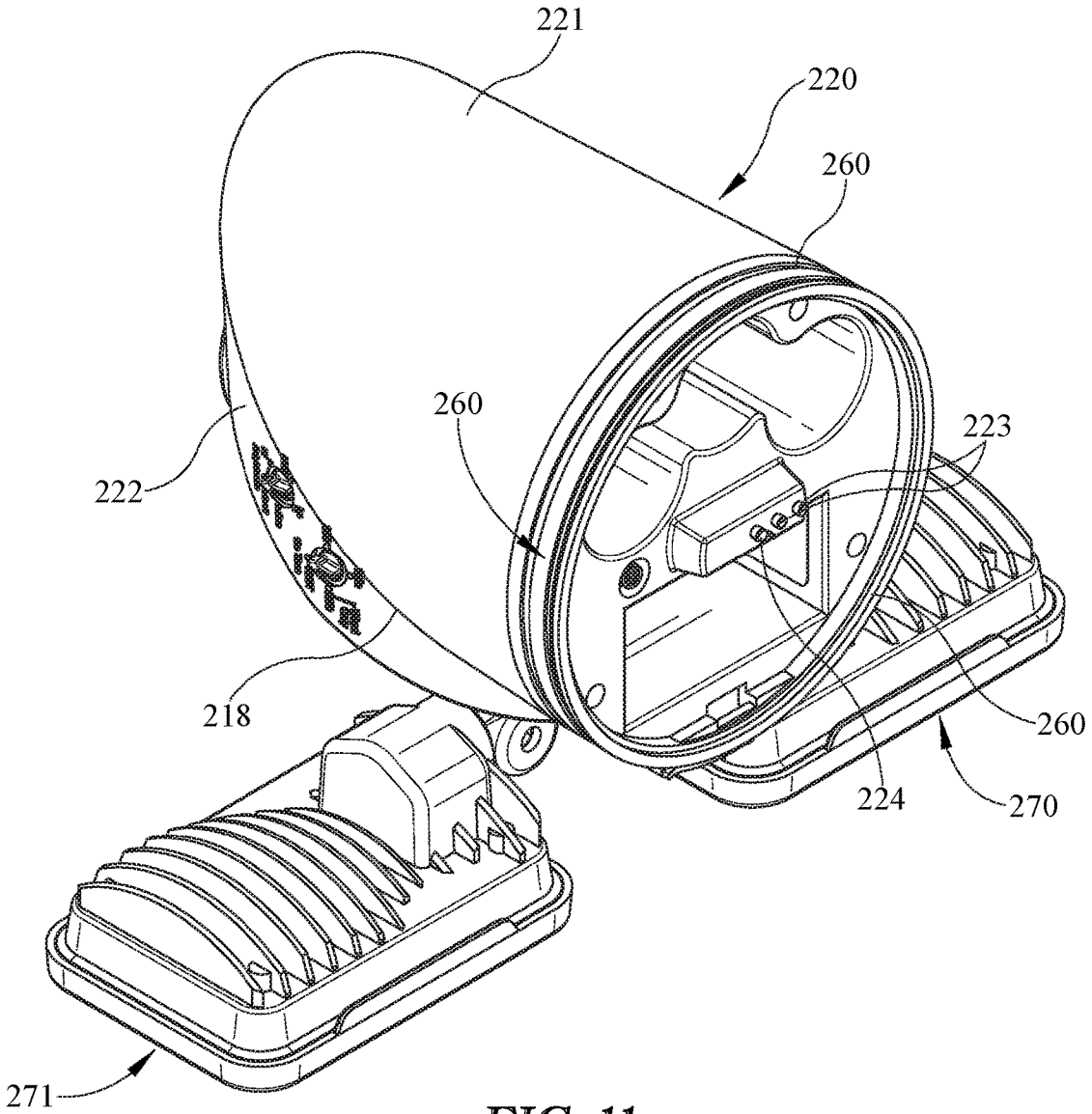
FIG. 11 illustrates a perspective view of the light fixture housing of FIG. 10 in a rotated position wherein the rear electrical connectors are exposed and visible.
Figure 12:
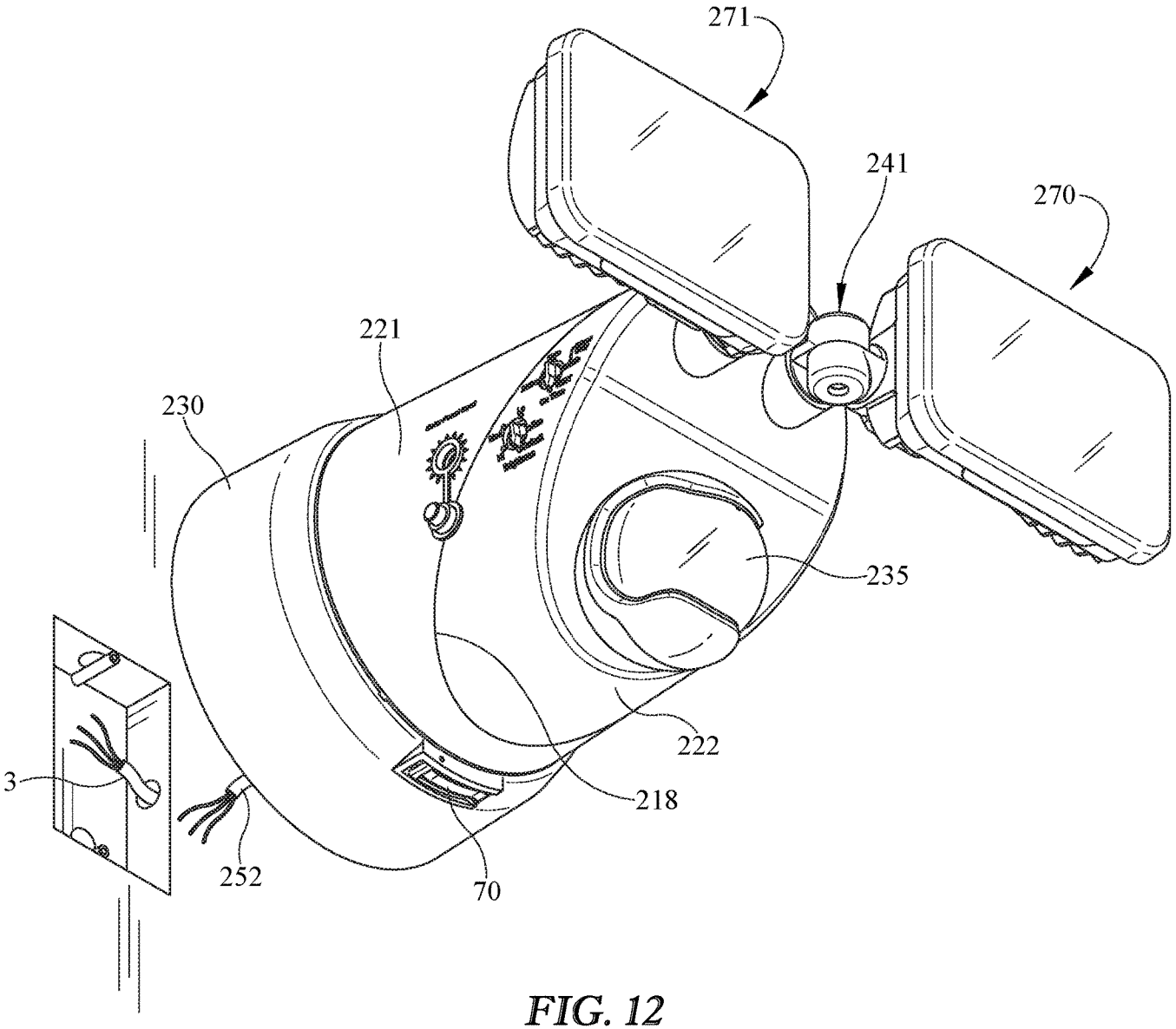
FIG. 12 illustrates a perspective view of the mounting base and light fixture housing of FIG. 10 combined together for installation on a vertical surface or wall.

Light fixture housing 220 is depicted in FIG. 10 and FIG. 11 as a security light having a first and second LED lamp heads 270, 271 affixed thereto to emit light when energized from the electrical contacts. The light fixture housing 220 as depicted has a first portion 221 and a second portion 222 which rotate relative to each other along an angled rotational interface 218. Rotational interface allow for installation of the light fixture housing 220 and mounting base 230 in different orientations, such as a wall mount, depicted in FIG. 12, or a ceiling or eaves mount depicted in FIG. 13. Providing rotational interface 218 and dividing the light fixture housing into a first portion 221 and second portion 222 allows the light fixture be properly oriented upon installation. Rotational interface 218 maintains the alignment between the firs portion 221 and the second portion 222 as well as an electrical connection to the lamp heads 270, 271 while allowing relative rotation of the two light fixture portions. Light fixture lamp heads 270, 271 may be bi-axis rotatable relative to the second lamp fixture portion to allow illumination zone adjustment. For example, lamp heads may have a two-axis hinge interface between the lamp head and the light fixture housing second portion. For example, a two-axis hinge may be a stacked first and second knuckle hinge 241 as depicted in FIG. 12. Other connections may also be utilized allowing two directional or axis adjustment of the lamp heads.

As shown in the FIGS. 11-14, the light fixture housing is rotatable along the rotation interface 218 allowing the first portion to rotate relative to the second portion 222. Installation can be varied as a result of the rotational interface 218 allowing the housing to be repositioned appropriately allowing the lamp heads 2710, 271 and other sensors, such as the motion sensor 235, to be directed outward. For example, as depicted in FIG. 12, the mounting base 230 may be installed against a horizontal surface, such as a side wall of a structure, adjacent or over a junction box allowing cables 3 to be connected to lamp housing wires 253. In the exemplary installation depicted, the light fixture housing faces directly way from the mounting surface and the angle rotational interface 218 allows the first portion and second portion 221, 222 of the light fixture housing to be aligned. Lamps heads depicted in FIG. 12 face outward from the installation surface.

Figure 13:
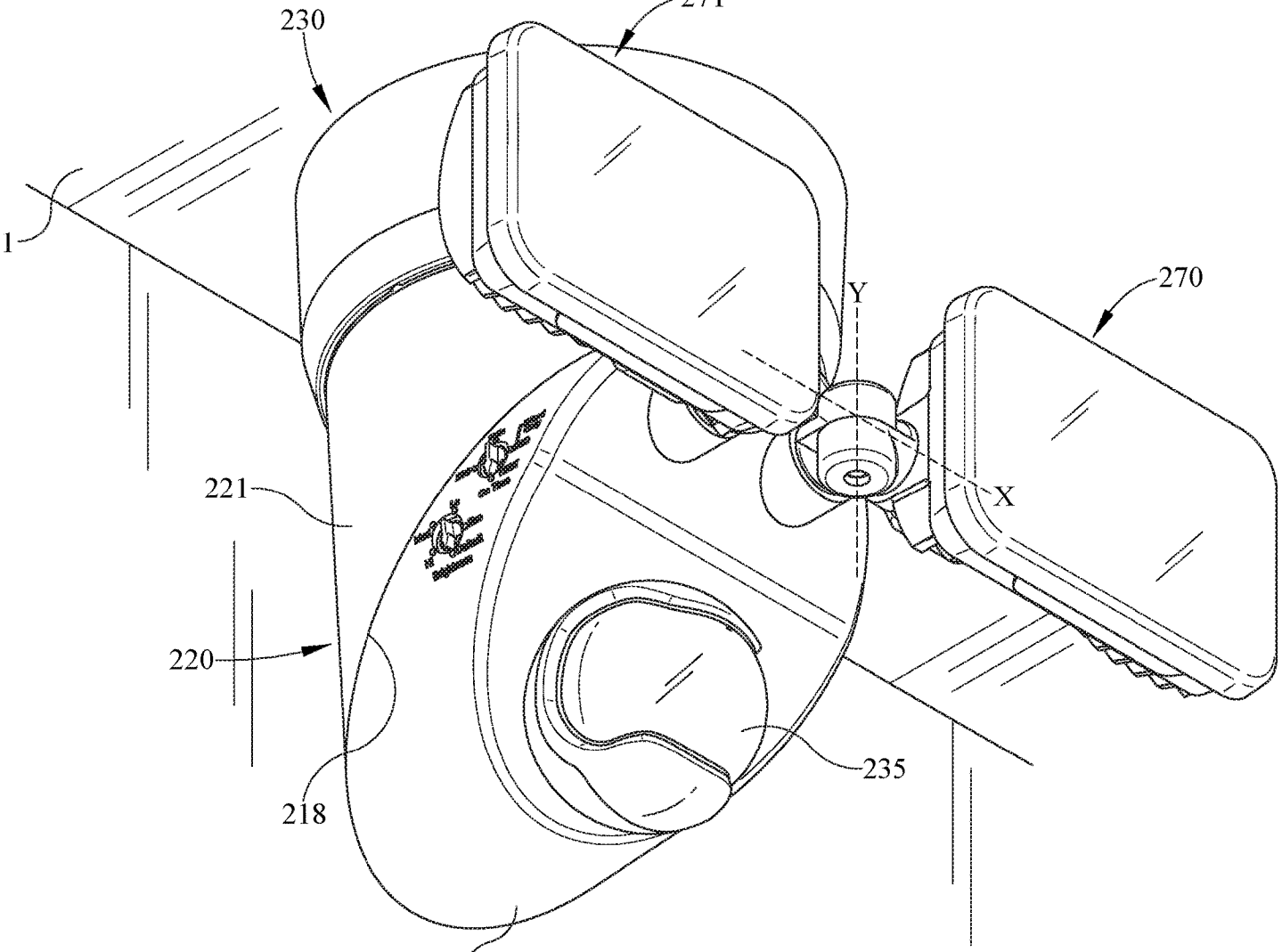
FIG. 13 illustrates a perspective view of the mounting base and light fixture housing of FIG. 10 combined together and the light fixture housing rotated for installation on a horizontal surface or ceiling.

In an alternative exemplary installation depicted in FIG. 13, the mounting base 230 is installed along a horizontal surface adjacent to or over a junction box allowing similar electrical connectivity. Rotation of the first portion and second portion of the light fixture housing along rotational interface 218 repositions the lamp heads and sensor 235 outward. In such an installation, the outward illumination and detection zones of the lamps and sensor(s) are approximately 90 degrees from the installation surface. The rotational interface 218 is angled relative to the rear mounting surface 259 of the light fixture housing 220 thereby allowing rotation of the two portions relative to each other for repositioning. In variations, an angled rotational interface is provided relative to the first portion and the second portion of the light fixture housing. For example, the angled rotational interface can be approximately 45 degrees relative to the rear mounting surface 259. In other examples, the angled rotational interface may be 0 degrees relative to the rear mounting surface or may be an alternative. For example, the interface may be 40 degrees relative to the rear mounting surface, or up to 50 to 60 degrees.

In variations, a rotatable light fixture 220 is depicted along with a receiving mounting base 230 which maintains electrical connectivity between the light fixture and the mounting base. In some embodiments, the light fixture housing 220 includes a plurality of electrical contacts 223, 224 in rotational engagement with the plurality of annularly exposed contacts 232, 233 of the mounting base 230. In various embodiments, the light fixture 220 maintains electrical connectivity between the electrical contacts of the light fixture and the contact of the mounting base for up to 360 degrees of rotational engagement between the light fixture 220 and the mounting base 230. In addition, in some embodiments, the light fixture 220 includes a plurality of modulated LEDs in lamp heads 270, 271 controlled by an LED controller, the plurality of LEDs in electrical connectivity with the electrical contacts of the light fixture housing. In various embodiments, the mounting base 230 and the light fixture 220 rotationally engage each other and are secured to each other through a mechanical locking mechanism. In some embodiments, the mechanical locking mechanism includes a cam lock and one or more retention members on the light fixture and the mounting base. In some examples, this may include a groove or receiving area in the light fixture housing. Additional examples may include at least one of the cam lock and one or more retention members which engage the annular groove 260 or which engage other structures or surfaces of the light fixture housing 220.

In other variations, the rotatable light fixture 220 may have a first portion and a second portion which have a rotational interface 218 there between allowing relative rotation between the first portion and the second portion. In some implementations, the rotational interface may be at an angle relative to a rear mounting surface of the light fixture housing 220. In other variations, the rotational interface may be at a zero-degree angle relative to the rear mounting surface. Electrical connectivity is maintained between the rotational interface between the electrical contacts 224, 223 and the LEDs of the lamp heads 270, 271 and additional sensors.

In further embodiments, the locking mechanism may be rotationally engaged retained on the base and rotate relative to the light fixture. Rotation of the cam lock allows the cam lock to lock the light fixture into a fixed relative positioned with respect to the base by engaging a corresponding groove or surface of the light fixture upon rotation.

In addition, in some embodiments, the plurality of rotational contacts of the light mounting base and the plurality of electrical contacts of the light fixture include at least one of an annular ring and a leaf spring or pin. In various embodiments, the pin or leaf spring includes a plurality of pins or leaf springs. In some embodiments, the plurality of pins or leaf springs are located on the light fixture. In various embodiments, the annular rings include a plurality of annular rings. In further embodiments, the annular rings are located on the mounting base. In even further embodiments, the annular rings of the mounting base are positioned in an associated number of annular grooves which receive the rings. In even further embodiments, a centrally positioned pin or disc may be centrally located and positioned relative to the annular rings on the mounting base. Moreover, in various embodiments, the plurality of rotational exposed contacts on the mounting base include a rotatable electrical plug which receives an electrically rotatable mating plug on the light fixture.

In some further embodiments, a rotatable light fixture may comprise a mounting base 230 electrically coupled to a junction box. In various embodiments, the light fixture may include a light fixture housing 220 rotatably connected to the mounting base 230 defining a plurality of rotational orientations between the light fixture housing and the mounting base. In some embodiments, the light fixture may include an electrical connection between the mounting base and the light fixture housing, wherein the electric connection is rotatably electrically engaged during the plurality of rotational orientations between the light fixture housing and the mounting base during rotation. In addition, in some embodiments, the light fixture housing and the mounting base is rotationally secured in at least one of the plurality of rotational orientations between the light fixture housing and the mounting base.

In addition, in various embodiments, the light fixture housing or the mounting base includes a cam lock 70 and one or more retention members 251, 252 and wherein the mounting base 230 or the light fixture housing 220 includes a receiving structure 260 or annular groove. In some implementations, the cam lock and the one or more retention members engage the annular groove or other surface or mating structure. In some embodiments, the cam lock or other locking mechanism 70 at least rotationally secures the light fixture housing relative to the mounting base in the at least one rotational orientation. In various embodiments, the cam lock may be utilized to axially secure the light fixture housing relative to the mounting base in the at least one rotational orientation. In some embodiments, the one or more retention members axially retain the light fixture housing with the mounting base. In various embodiments, the one or more retention members include a first retention member 251 and a second retention member 252, wherein the first retention member is different from the second retention member. In some embodiments, the first retention member and the second retention member rotationally and axially engage an annular groove or other structure allowing rotation of the light fixture housing relative to the mounting base while maintaining the relative axial position between the light fixture housing and the mounting base, and wherein a first axial removal force to separate the second retention member from the annular groove is less than a second axial removal force to separate the first retention member from the annular groove thereby allowing axial separation of the light fixture housing from the mounting base when the cam lock is disengaged. In various embodiments, the cam lock is on an opposing side of the light fixture housing than the first retention member.

In implementations, the light fixture housing 220 may be a security light. In examples, the light fixture housing may be rotationally connectable to the mounting base 230 and may also have a first portion 221 and a second portion 222 that are rotatable relative to each other. In other examples, the light fixture housing may have at least one lamp head 271 extending outward from the second portion 222 of the light fixture housing. The lamp heads may have a plurality of LEDs or other light sources which are controlled by a lighting controller or other electronics. In implementations where the lamp heads have at least one or a plurality of LEDs, the LEDs may be controlled by an LED controller and/or LED drivers.

In implementations, the light fixture housing 220 may be a two-part light fixture housing having a first portion 221 and a second portion 222. In optional examples, the light fixture housing may have a rotational interface 218 positioned between the first portion and the second portion. In further examples and implementations, the rotational interface may be angled relative to a rear mounting surface of the light fixture housing 220. In some of these examples, the rotational interface 218 is angled about 45 degrees relative to the rear mounting base surface 230 of the light fixture housing. In some other examples, the rotational interface may be more or less than 45 degrees relative to the rear mounting surface of the light fixture housing. In variations, the rotational interface may be anywhere between zero and sixty degrees or more. In still further implementations, the first portion may rotate relative to the second portion by about 180 degrees. In other examples, the first portion may rotate more or less than 180 degrees relative to the second portion. For example, rotation of up to 360 degrees may be allowed.

In embodiments, a light fixture housing may be provided which is rotationally connected to a mounting base. In other examples, the light fixture itself may provide additional rotational adjustment by providing relative rotation between a first portion and a second portion of the light fixture housing thereby providing two or more rotational adjustments.

In some embodiments, the electrical connection between the mounting base and the light fixture housing includes hot, neutral, and ground connections electrically maintained for up to 360 degrees or less of rotation between the mounting base and the light fixture housing. Moreover, in some embodiments, the light fixture housing and the mounting base each include a plurality of electrical contacts rotationally held in electrical contact with the other of the light fixture housing and the mounting base. In various embodiments, the mounting base 230 includes reusable push-in wire connectors to electrically connect to an electrical hot, neutral, and ground wires of the junction box. In some embodiments, the light fixture 220 includes one or more gaskets between the light fixture housing and the mounting base. In some implementations, the light fixture housing receives low voltage electricity from the mounting base wherein the mounting base has associated electronics to convert line voltage to low voltage. In implementations, the voltage reduction from line voltage 120V down to about 20V occurs within the mounting base. In other implementations, the voltage reduction can occur within the light fixture housing. In still further implementations, the electrical connection to the mounting base may me modulated or modified to an appropriate characteristic to drive light fixtures so that further modification is not required. For example, in some implementations, the electrical connection at the junction box is provided at standard 120V AC. In some examples, this standard 120V AC is fed into the mounting base. The mounting base may include voltage modification and reduction electronics to modify the electrical connection provided directly to the electrical interface between the mounting base and the light fixture housing. For example, in some implementations the voltage may be reduced from 120V AC to about 20V DC or less. Modification of the electrical connection from 120V AC to a lower voltage DC may be accomplished with many known methods and electronic circuits. For example, a transformers, bridge rectifier, switches, digital methods such as modulation and other circuits or resistors may be readily utilized.

In addition, in various embodiments, the light fixture or the mounting base may include a cam lock rotationally securing the light fixture housing relative to the mounting base in the at least one rotational orientation and sealing the one or more gaskets between the light fixture housing and the mounting base. In some embodiments, the light fixture housing includes one or more light sources. Moreover, in some embodiments, the light fixture includes a depending skirt with one or more receiving grooves or other structures which interface with engaging retention members.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A rotatable light fixture and receiving mounting base which maintains electrical connectivity between the light fixture and the mounting base, comprising:

the mounting base mountable to a surface and electrically connectable to a junction box and power supply wires of the junction box;

the mounting base having a plurality of annularly extending rotationally exposed contacts and a third contact positioned with the annularly extending rotationally exposed contacts;

the rotatable light fixture including a plurality of electrical contacts in rotational engagement with the plurality of annularly extending rotationally exposed contacts and the third contact of the mounting base;

wherein the light fixture maintains electrical connectivity between the plurality of electrical contacts of the light fixture and the plurality of annularly extending rotationally exposed contacts of the mounting base for rotational engagement between the light fixture and the mounting base;

wherein the light fixture includes a plurality of LEDs, the plurality of LEDs in electrical connectivity with the plurality of electrical contacts of the light fixture;

the mounting base and the light fixture rotationally engaged to each other and rotationally secured to each other through a mechanical locking mechanism.

2. The rotatable light fixture of claim 1 wherein the mechanical locking mechanism includes one or more retention members on one of the mounting base and the light fixture.

3. The rotatable light fixture of claim 2 wherein the light fixture has a first portion and a second portion, the first portion rotatable relative to the second portion.

4. The rotatable light fixture of claim 3 wherein the light fixture first portion rotates relative to the light fixture second portion along a rotational interface.

5. The rotatable light fixture of claim 4 wherein the rotational interface is angled relative to a rear mounting surface of the light fixture.

6. The rotatable light fixture of claim 5 wherein the rotational interface is angled about 40 degrees relative to the rear mounting surface of the light fixture.

7. The rotatable light fixture of claim 2 wherein the light fixture and the mounting base have a first rotational interface and the light fixture has a second rotational interface, both the first and the second rotational interface maintaining electrical connectivity between the plurality of LEDs and the power supply wires of the junction box.

8. The rotatable light fixture of claim 1 wherein the mechanical locking mechanism includes a rotatable cam lock or a magnet on one of the mounting base and the light fixture.

9. The rotatable light fixture of claim 8, one of the mounting base and light fixture having an annular groove which receives the rotatable cam lock to lock the rotatable cam lock into the annular groove when the rotatable cam lock is activated and fixate the position the light fixture relative to the mounting base.

10. The rotatable light fixture of claim 8, one of the mounting base or light fixture having a surface which engages the rotatable cam lock to lock the rotatable cam lock onto the surface when the rotatable cam lock is activated and fixate the position the light fixture relative to the mounting base.

11. The rotatable light fixture of claim 8 wherein the rotational engagement is about 360 degrees or less.

12. A rotatable light fixture comprising:

a mounting base structured to be electrically coupled to a junction box;

a light fixture housing rotatably connected to the mounting base defining a plurality of rotational orientations between the light fixture housing and the mounting base;

an electrical connection between the mounting base and the light fixture housing, wherein the electrical connection is rotatably electrically engaged during the plurality of rotational orientations between the light fixture housing and the mounting base during rotation;

wherein the electrical connection between the mounting base and the light fixture housing includes a plurality of electrical contacts on the mounting base combined with a plurality of electrical contacts on the light fixture housing in rotational engagement with the plurality of electrical contacts on the mounting base; and the light fixture housing and the mounting base rotationally secured in at least one of the plurality of rotational orientations between the light fixture housing and the mounting base;

wherein one of the light fixture housing and the mounting base includes at least one of a cam lock and one or more retention members to rotationally retain the light fixture housing to the mounting base.

13. The rotatable light fixture of claim 12 wherein the other of the mounting base or the light fixture housing includes an annular groove, wherein the at least one of the cam lock and the one or more retention members engage the annular groove.

14. The rotatable light fixture of claim 13 wherein the cam lock at least rotationally secures the light fixture housing relative to the mounting base in the plurality of rotational orientations.

15. The rotatable light fixture of claim 14 wherein the cam lock axially secures the light fixture housing relative to the mounting base.

16. The rotatable light fixture of claim 14 wherein the one or more retention members axially retain the light fixture housing with the mounting base.

17. The rotatable light fixture of claim 14 wherein the one or more retention members include a first retention member and a second retention member, wherein the first retention member is different from the second retention member.

18. The rotatable light fixture of claim 17 wherein the first retention member and the second retention member rotationally and axially engage the annular groove allowing rotation of the light fixture housing relative to the mounting base while maintaining a relative axial position between the light fixture housing and the mounting base, and wherein a first axial removal force to separate the second retention member from the annular groove is less than a second axial removal force to separate the first retention member from the annular groove thereby allowing axial separation of the light fixture housing from the mounting base when the cam lock is disengaged from the annular groove.

19. The rotatable light fixture of claim 13 wherein the light fixture housing includes a light fixture housing first portion and a light fixture housing second portion, the first portion rotatable relative to the second portion.

20. The rotatable light fixture of claim 19 wherein the light fixture housing first portion rotates relative to the light fixture housing second portion along a rotational interface.

21. The rotatable light fixture of claim 20 wherein the rotational interface is angled relative to a rear mounting surface of the light fixture housing.

22. The rotatable light fixture of claim 21 wherein the rotational interface is angled about 40 degrees relative to the rear mounting surface of the light fixture housing.

23. The rotatable light fixture of claim 20 wherein the light fixture housing and the mounting base have a first rotational interface and the light fixture housing has a second rotational interface, both the first and the second rotational interface maintaining electrical connectivity between a plurality of LEDs in the light fixture housing and an electrical connection leading to the junction box.

24. The rotatable light fixture of claim 19 wherein the electrical connection between the mounting base and the light fixture housing includes hot, neutral, and ground connections electrically maintained for up to about 360 degrees of rotation between the mounting base and the light fixture housing.

25. The rotatable light fixture of claim 12 wherein the light fixture housing and the mounting base each include the plurality of electrical contacts rotationally held in electrical contact with the other of the light fixture housing and the mounting base.

26. A rotatable light fixture comprising:

a mounting base structured to be electrically coupled to a junction box;

a light fixture housing rotatably connected to the mounting base defining a plurality of rotational orientations between the light fixture housing and the mounting base;

an electrical connection between the mounting base and the light fixture housing, wherein the electrical connection is rotatably electrically engaged during the plurality of rotational orientations between the light fixture housing and the mounting base during rotation;

wherein the electrical connection between the mounting base and the light fixture housing includes a plurality of electrical contacts on the mounting base combined with a plurality of electrical contacts on the light fixture housing in rotational engagement with the plurality of electrical contacts on the mounting base; and the light fixture housing and the mounting base rotationally secured in at least one of the plurality of rotational orientations between the light fixture housing and the mounting base;

wherein one of the light fixture housing and the mounting base includes at least one of a cam lock and one or more retention members to rotationally retain the light fixture housing to the mounting base;

the light fixture housing having a first portion and a second portion, wherein the first portion is rotatable relative to the second portion by up to about 180 degrees.

27. The rotatable light fixture of claim 26 wherein the first portion of the light fixture housing rotates relative to the second portion of the light fixture housing along an angled rotational interface.

28. A rotatable light fixture comprising:

a mounting base structured to be electrically coupled to a junction box;

a light fixture housing rotatably connected to the mounting base defining a plurality of rotational orientations between the light fixture housing and the mounting base;

an electrical connection between the mounting base and the light fixture housing, wherein the electrical connection is rotatably electrically engaged during the plurality of rotational orientations between the light fixture housing and the mounting base during rotation;

wherein the electrical connection between the mounting base and the light fixture housing includes a plurality of electrical contacts on the mounting base combined with a plurality of electrical contacts on the light fixture housing in rotational engagement with the plurality of electrical contacts on the mounting base; and the light fixture housing and the mounting base rotationally secured in at least one of the plurality of rotational orientations between the light fixture housing and the mounting base;

the light fixture housing having a first portion and a second portion, wherein the first portion is rotatable relative to the second portion by up to about 180 degrees.

29. A rotatable light fixture comprising:

a mounting base structured to be electrically coupled to a junction box;

a light fixture housing rotatably connected to the mounting base defining a plurality of rotational orientations between the light fixture housing and the mounting base;

an electrical connection between the mounting base and the light fixture housing, wherein the electrical connection is rotatably electrically engaged during the plurality of rotational orientations between the light fixture housing and the mounting base during rotation;

wherein the electrical connection between the mounting base and the light fixture housing includes a plurality of electrical contacts on the mounting base combined with a plurality of electrical contacts on the light fixture housing in rotational engagement with the plurality of electrical contacts on the mounting base; and the light fixture housing and the mounting base rotationally secured in at least one of the plurality of rotational orientations between the light fixture housing and the mounting base;

the light fixture housing having a first portion and a second portion, wherein the first portion is rotatable relative to the second portion by up to about 180 degrees;

wherein the mounting base receives an electrical connection from the junction box and converts electricity from about 120 volts AC to about 20 volts DC at the electrical connection between the mounting base and the light fixture housing.

* * * * *